US012649605B2

(12) United States Patent
Cohen et al.

(10) Patent No.: US 12,649,605 B2
(45) Date of Patent: Jun. 9, 2026

(54) CONTAINERS FOR CAKE POPS

(71) Applicant: CYRIL'S FOODS COMPANY, Sanford, NC (US)

(72) Inventors: Cyril Cohen, R. Lauderdale, FL (US); Marc Meyer, Cedar Springs, MI (US)

( * ) Notice: Subject to any disclaimer, the term of this patent is extended or adjusted under 35 U.S.C. 154(b) by 0 days.

(21) Appl. No.: 18/327,398

(22) Filed: Jun. 1, 2023

(65) Prior Publication Data

US 2024/0400249 A1 Dec. 5, 2024

(51) Int. Cl.
*B65D 85/60* (2006.01)
*B65D 1/24* (2006.01)

(52) U.S. Cl.
CPC ..... *B65D 1/24* (2013.01); *B65D 85/60* (2013.01); *B65D 2585/363* (2013.01)

(58) Field of Classification Search
CPC ..... B65D 85/60; B65D 1/24; B65D 2585/363
See application file for complete search history.

(56) References Cited

U.S. PATENT DOCUMENTS 3,104,172 A * 9/1963 Wizelman ..... B65D 75/36 426/119
4,899,877 A * 2/1990 Kiernan ..... B65D 75/245 206/349
5,405,009 A * 4/1995 Hackenbracht ..... B65D 43/162 220/4.23
5,447,232 A * 9/1995 Chow ..... B65D 75/245 206/378
7,584,852 B2 * 9/2009 O'Brien ..... B65D 81/133 206/433
D942,223 S 2/2022 Pena
D956,482 S 7/2022 Jones
2020/0307900 A1 10/2020 Parikh et al.
2020/0377266 A1 * 12/2020 Lotfi ..... B65D 43/162

OTHER PUBLICATIONS

Amazon.com, Cake Pop Boxes 50 Pack Single Cake-Pop-Box with Holes 2"x2"x2" Small Gift Boxes Candy Boxes Mini Plastic Boxes Treat Boxes, accessed Aug. 24, 2022, 7 pages.
Amazon.com, Cake Pop Stand, accessed Aug. 24, 2022, 9 pages.
Amazon.com, Weltex store white boxes Cake Pop Packaging with Holes for 12, accessed Aug. 24, 2022, 8 pages.
Coco Bakery, Cake Pops packaging, Jul. 13, 2023, 1 page.
Olivia's, Cake Pops packaging, Jan. 9, 2023, 2 pages.
Harristeeter.com, Macarooz Assorted Mac Pops™, accessed Oct. 25, 2022, 2 pages.
Naturamarket, proudly Canadian, Olivia's Cake Pops, https://naturamarket.ca/olivia-s-cake-pops-blue-confetti-6-pack.html (accessed Jul. 22, 2025) 1 page.

* cited by examiner

*Primary Examiner* — Stephen J Castellano
(74) *Attorney, Agent, or Firm* — Derek Fahey, Esq.; The Plus IP Firm, PLLC

(57) ABSTRACT

Containers for cake pops have an upper and a lower that are mateable to one another to form a closed position in which the upper and lower define a plurality of cake pop-shaped cavities each having a cake receiving portion and a stick receiving portion. Each cake receiving portion of the lower has a base having a first exterior surface defining a first plane lying parallel to a sheet portion of the lower and a second exterior surface contoured inward and having a shape to match an exterior surface of the cake-receiving portion of the upper.

18 Claims, 18 Drawing Sheets

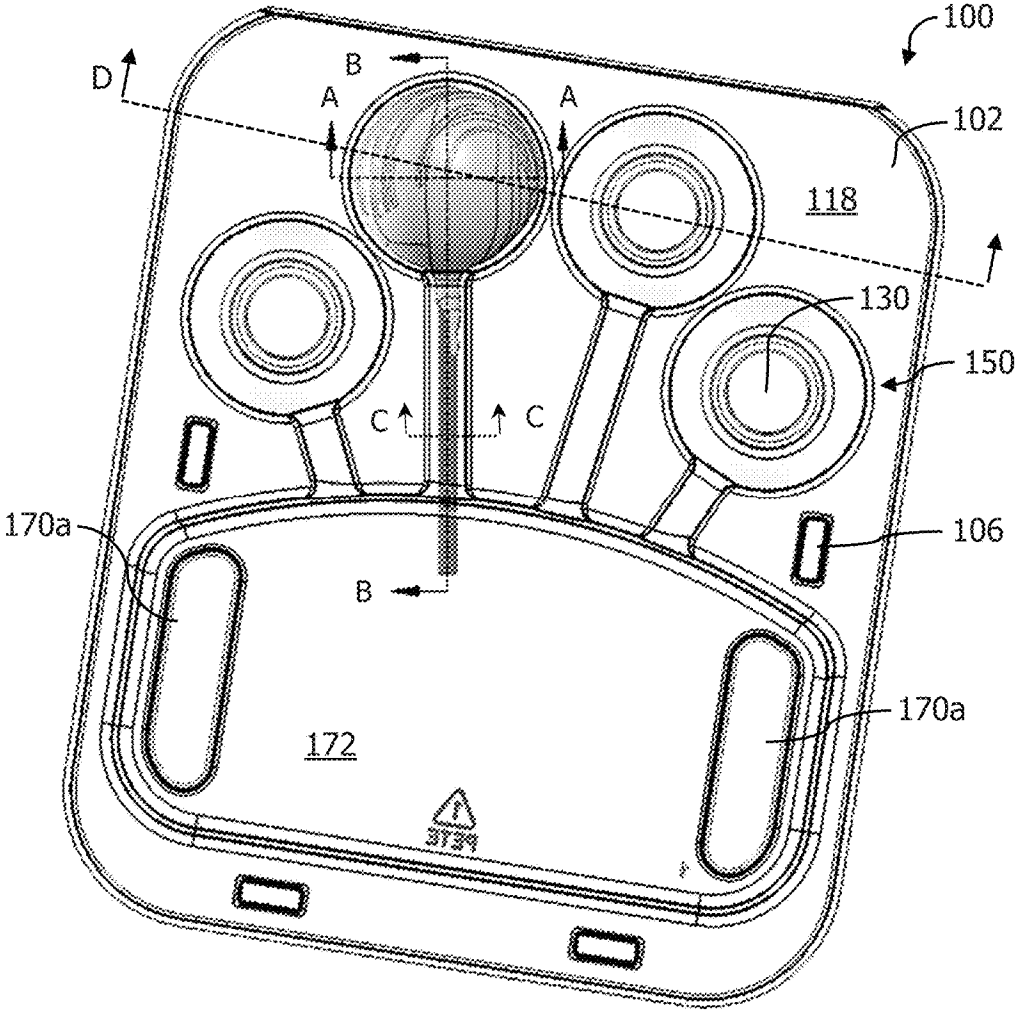
FIG. 5
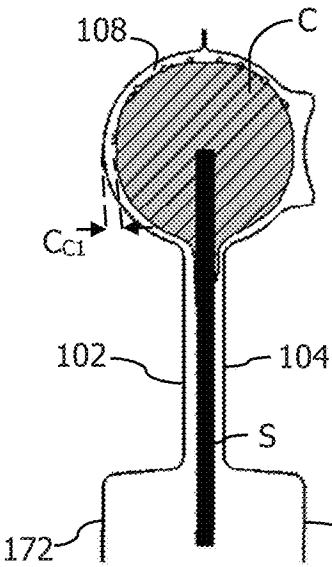
Section B-B
FIG. 7
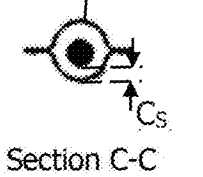
Section C-C
FIG. 8
Section A-A
FIG. 6

FIG. 12A
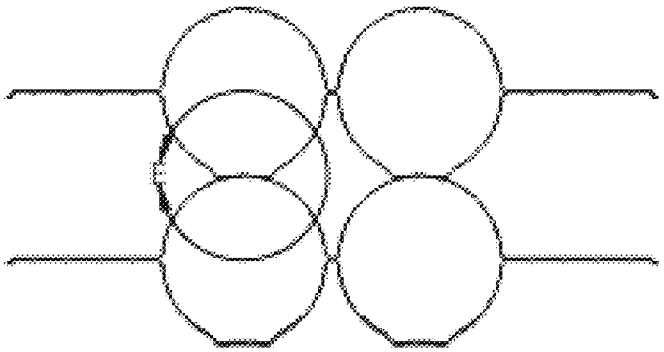
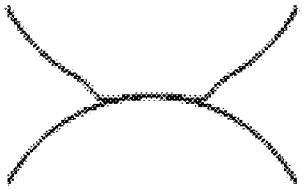
DETAIL E
FIG. 12B
FIG. 13A
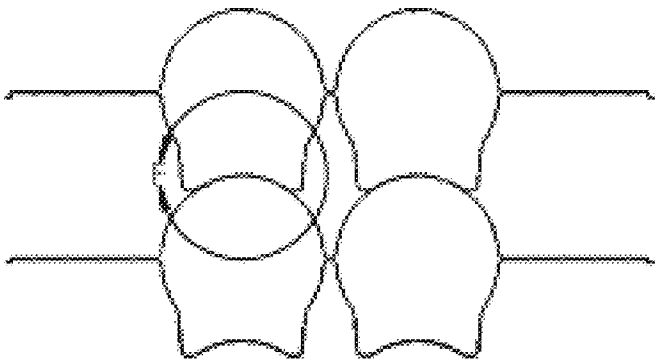
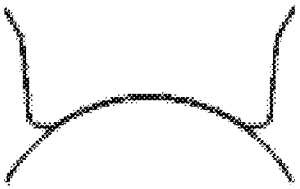
DETAIL F
FIG. 13B

CONTAINERS FOR CAKE POPS

TECHNICAL FIELD

This application relates to containers for cake pops, more particularly, to containers having an upper and a lower that in mated form define a plurality of cake pop receptacles that each terminate with a bottom having an inverted dome surface mateable for stacking on the spherical upper surface of a respective cake pop receptacle in another one of the containers.

BACKGROUND

Cake pops are a delicious desert presented on a stick, typically with a spherical cake portion, shaped like a lollipop. The shape and softness of the cake portion presents transportation, display, and stickability challenges, especially if shipping and displaying in retail stores. The cake portion can be crushed or deformed if too much pressure is applied thereto, and the sticks can make it difficult to orient the cake pops in containers.

Traditionally, cake pops are presented vertically with the stick oriented downward into some type of holder, for example as shown in U.S. D956482. Occasionally, cake pops are flipped and displayed with the cake pop downward, for example as shown in D942223. None of these are ideal for shipping large quantities of cake pops to distributors, such as grocery stores and the like.

An additional challenge is providing enough flat surface area for the inclusion of a label. The label needs to have enough space to include the ingredients and other required information, as well as logos and identifying information.

There is a need for a container for cake pops that enables the cake pops to lie horizontally without risk of damage to the cake portion, while maintaining the sticks in a desired orientation, which are stackable, but are also displayable in a store.

SUMMARY

In one aspect, containers for cake pops have an upper and a lower that are mateable to one another to form a closed position in which the upper and lower define a plurality of cake pop-shaped cavities. Each cake-pop shaped cavity has a cake receiving portion and a stick receiving portion and each cake receiving portion of the lower has a base having a first exterior surface defining a first plane lying parallel to a sheet portion of the lower and a second exterior surface contoured inward and having a shape to match an exterior surface of the cake-receiving portion of the upper. In one embodiment, the second exterior surface of the base of the lower is an inverted dome surface mateable for stacking on a spherical exterior surface of a cake-receiving portion of a non-mated upper.

In some embodiments, each stick receiving portion has a terminal end that is an open end that terminates into a unitary cavity. The unitary cavity has an internal first height that is greater than an internal second height of the stick receiving portion, and the unitary cavity is configured for a free end of a stick of each of a plurality of cake pops to be suspended therein in an unsupported manner. When the unitary cavity is present, the stick receiving portion, in the closed position, is a cylindrically shaped tube have a length in a range of ½ inch to 2½ inch.

In embodiments having a unitary cavity, the first plane of the lower has an exterior surface of a first stacking feature positioned on the unitary cavity and shaped to mate with a second stacking feature of a separate container for cake pops.

In embodiments having a unitary cavity, a planar exterior surface of the unitary cavity defined by the lower that lies parallel to a sheet portion of the lower comprises a first stacking feature, and the planar exterior surface of the unitary cavity defined by the upper that lies parallel tom a sheet portion of the upper and comprises a second stacking feature. The upper defines an outer plane in which an outermost point of each domed exterior surface of each of the plurality of cake receiving portions and a planar exterior surface of the unitary cavity both lie.

In some embodiments, in the closed position, the cake pop-shaped receiving cavities are oriented as mirror image pairs having their respective stick receiving portions aligned with their respective terminal ends facing one another. There can be two, three, four or more mirror image pairs of cake pop-shaped receiving cavities.

In all embodiments, the upper and the lower can be formed of molded plastic.

In some embodiments, each cake pop-shaped cavity is oriented at an angle relative to a central longitudinal axis and positions the terminal end of each stick receiving portion closer to the central longitudinal axis than a junction of each stick receiving portion with a respective cake receiving portion. Further, at least one of the plurality of cake pop-shaped cavities has the cake receiving portion thereof positioned offset in two dimension from an immediately neighboring cake receiving portion of another of the plurality of cake pop-shaped cavities.

In all embodiments, the upper and lower, in the closed position, have mating means. The mating means can be selected from the group consisting of a fastener, an adhesive tape or adhesive label, a shrink wrap band, a heat weld, and combinations thereof. The fastener can be a snap-fit detent and mating receptacle, a snap-fit or friction fit mating flanges, a deformable flange, a depressible tab, and combinations thereof.

In some embodiments, the unitary cavity portion of the upper or of the lower comprises a flange extending along one side thereof and protruding outward and terminating flush with the outer plane of the upper or the opposing outer plane of the lower, respectively. The flange is contoured to sit in registration on a surface of a respective unitary cavity portion of a separate container for cake pops as one type of a stacking feature.

In another aspect, containers for cake pops are disclosed that have an upper and a lower each hingedly connected to a triangular prism-shaped base and closable to mate the upper and lower and thereby form one or more cake pop-shaped cavities. In the closed position, the upper and the lower each have an angled surface seated with respect to a first elongate side and a second elongate side of the triangular prism-shaped base, respectively. Each cake pop-shaped cavity has a cake receiving portion and a stick receiving portion. Each cake receiving portion of the lower has a base having a first exterior surface defining a first plane that includes a first hinge that couples the lower to the triangular prism-shaped base and having a second exterior surface contoured inward and having a shape to match an exterior surface of the cake-receiving portion of the upper. The lower comprises at least a first pair of cake receiving portions and stick receiving portions and the upper comprises an aligned pair of cake receiving portions.

In one embodiment, the first pair of stick receiving portions are oriented with the terminal ends thereof angled toward one another. The triangular prism-shaped base defines a recess shaped to mate with the terminal ends of the first pair of stick receiving portions, in the closed position.

In another embodiment, the cake pop-shaped cavities are oriented side-by-side with the cake receiving portions pointed in opposite directions, and the triangular prism-shaped base defines a portion of one of the cake receiving portions and a recess shaped to mate with one terminal end of a stick receiving portion.

BRIEF DESCRIPTION OF THE DRAWINGS

FIG. 5 is a front plan view of the container of FIG. 1 with a cake pop illustrated therein.

FIG. 6 is a transverse cross-section view through the cake portion of the cake pop along line A-A of FIG. 5.

FIG. 7 is a longitudinal cross-section view through the cake pop (cake and stick portions) along line B-B of FIG. 5.

FIG. 8 is a transverse cross-section view through the stick of the cake pop along line C-C of FIG. 5.

FIG. 12A is a line drawing illustrating an alternate nesting depth which is less than the nesting depth of FIGS. 10 and 11.

FIG. 12B is an enlargement of detail E of FIG. 12A.

FIG. 13A is a line drawing illustrating an alternate nesting depth which is more than the nesting depth of FIGS. 10 and 11.

FIG. 13B is an enlargement of detail F of FIG. 13A.

DETAILED DESCRIPTION

Figure 1:
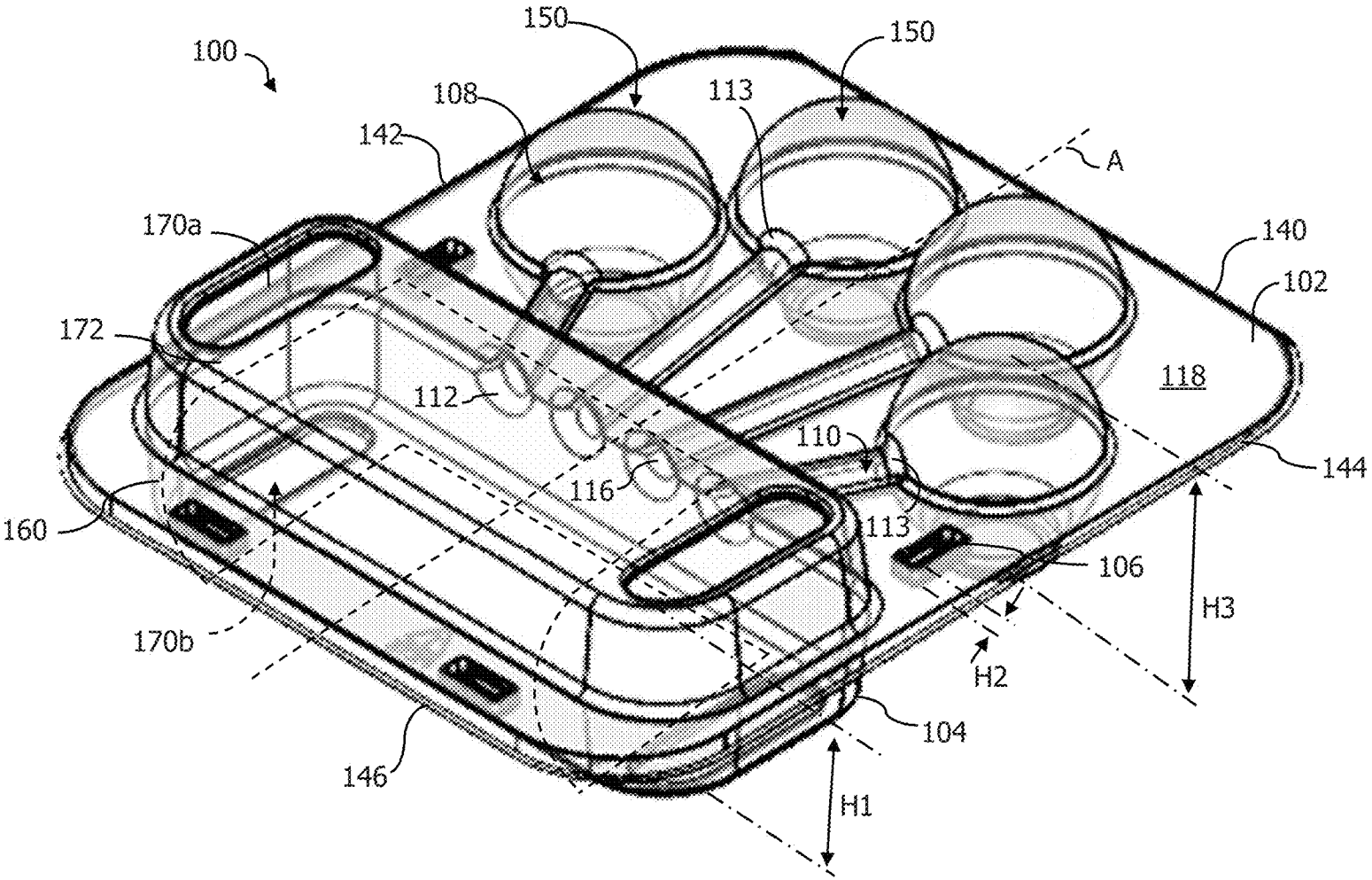
FIG. 1 is a front perspective view of one embodiment of a closed container for cake pops.

The following description and drawings are illustrative and are not to be construed as limiting. In the drawings, like reference numbers indicate identical or functionally similar elements. Numerous specific details are described to provide a thorough understanding of the disclosure.

Figure 2:
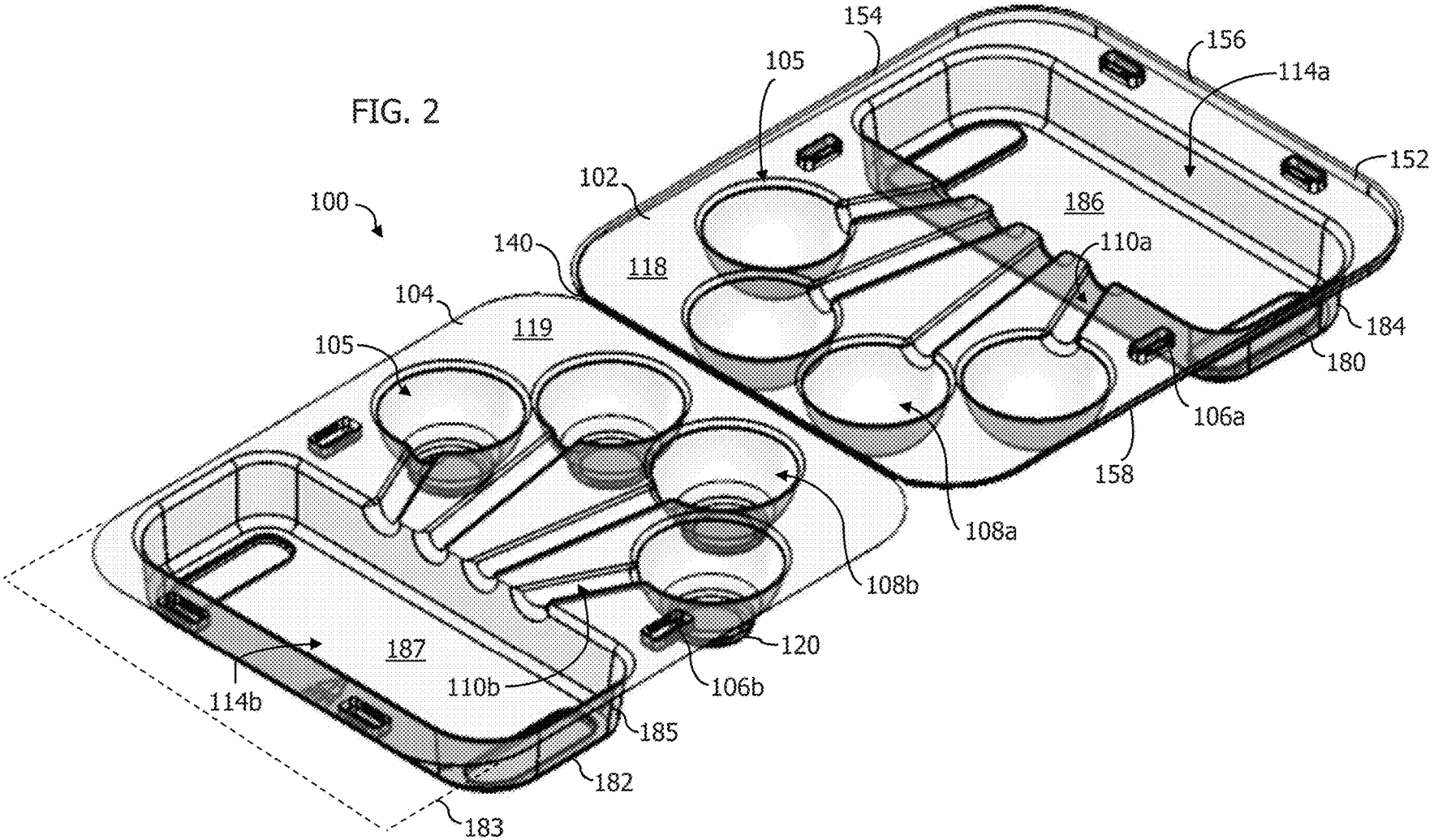
FIG. 2 is front perspective view of the container of FIG. 1 in an open position.

Referring to FIGS. 1-7, a container 100 for cake pops has an upper 102 and a lower 104 that are mateable to one another by a mating means 106. The upper and lower 102, 104 in mated form, as shown in FIG. 2, define a plurality of cake pop-shaped cavities 105, each having a cake receiving portion 108 (108*a* in the upper and 108*b* in the lower) and a stick receiving portion 110 (110*a* in the upper and 110*b* in the lower). Each stick receiving portion 110, in mated form, terminates with a terminal, open end 112, best seen in FIG. 1, into an enlarged, unitary cavity 114. The unitary cavity 114 has a first internal height H1 that is greater than a second internal height H2 of the stick receiving portion, such that a free end of a stick of each of a plurality of cake pops is suspended therein in an unsupported manner as shown in FIG. 5. In the figures, the cake pops and hence the cake receiving portion 108 are spherical but are not limited thereto. The cake pops can be square, rectangular, or any other geometric shape, including ornamental shapes, such as hearts, snowmen, cylindrical like a marshmallow, or any other celebration or holiday type shape.

The upper 102 and the lower 104 are made of a plastic material. The upper and lower are typically formed by molding the plastic material. In one embodiment, the upper and the lower are vacuum molded. Vacuum molding includes heating a sheet of a thermoplastic material and positioning the same over a mold, female molds for the current upper and lower, moving the mold into the sheet of thermoplastic material to create a seal therebetween, and vacuum suctioning air from between the sheet of thermoplastic material and the mold, thereby deforming the sheet of thermoplastic material into the mold. Thereafter, the molded thermoplastic material is cooled and removed from the mold. The molded thermoplastic material may be cooled by air or water and air may be used to help separate the molded thermoplastic material from the mold. The sheet of thermoplastic material may be a medium gauge sheet or a heavy gauge sheet. Medium gauge sheets have a thickness of between 60 mils and 120 mils, and heavy gauge sheets have a thickness of 120 mils or greater. Example thermoplastic materials include, but are not limited to, high density polyethylene (HDPE), high molecular weight polyethylene (HMWPE), thermoplastic olefin (TPO), polyethylene terephthalate (PET), polyvinyl chloride (PVC), acrylonitrile butadiene styrene (ABS), polystyrene, polyethylene, polypropylene, and blends thereof. In one embodiment, the thermoplastic material is PET, and the thermoplastic material is a heavy gauge sheet. In one embodiment, the PET has a thickness in a range of 100 mils to 200 mils thick.

Figure 14:
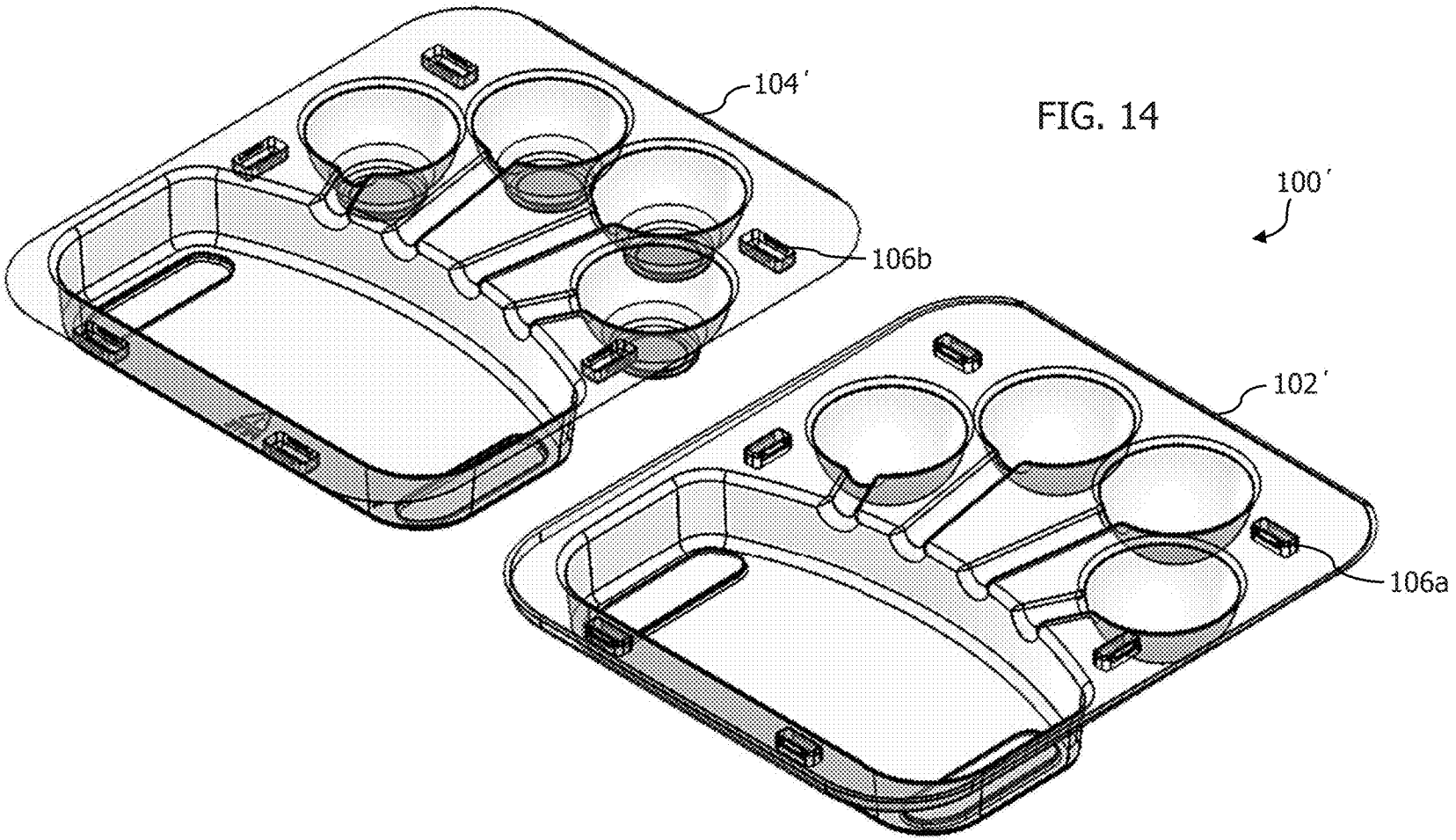
FIG. 14 is a front perspective view of a second embodiment of a container for cake pops in an open position.

Referring again to FIGS. 1-5, the upper 102 and the lower 104 are shown as being integral with one another along a hinge 140. The hinge 140, as illustrated, joins the upper and lower along their top ends. In another embodiment, the hinge can be along either the left side 142 of the upper or the right side 144 of the upper. In yet another embodiment, the hinge can be along the bottom ends 146 of the upper and lower 102, 104. Further, in contrast, as shown in FIG. 14, the container 100' can have an upper 102' and a lower 104' that are separate from one another (not hinged together) but that are still mateable by the mating means 106. All other features of FIG. 14 are the same as those described for FIGS. 1-13.

Figure 3:
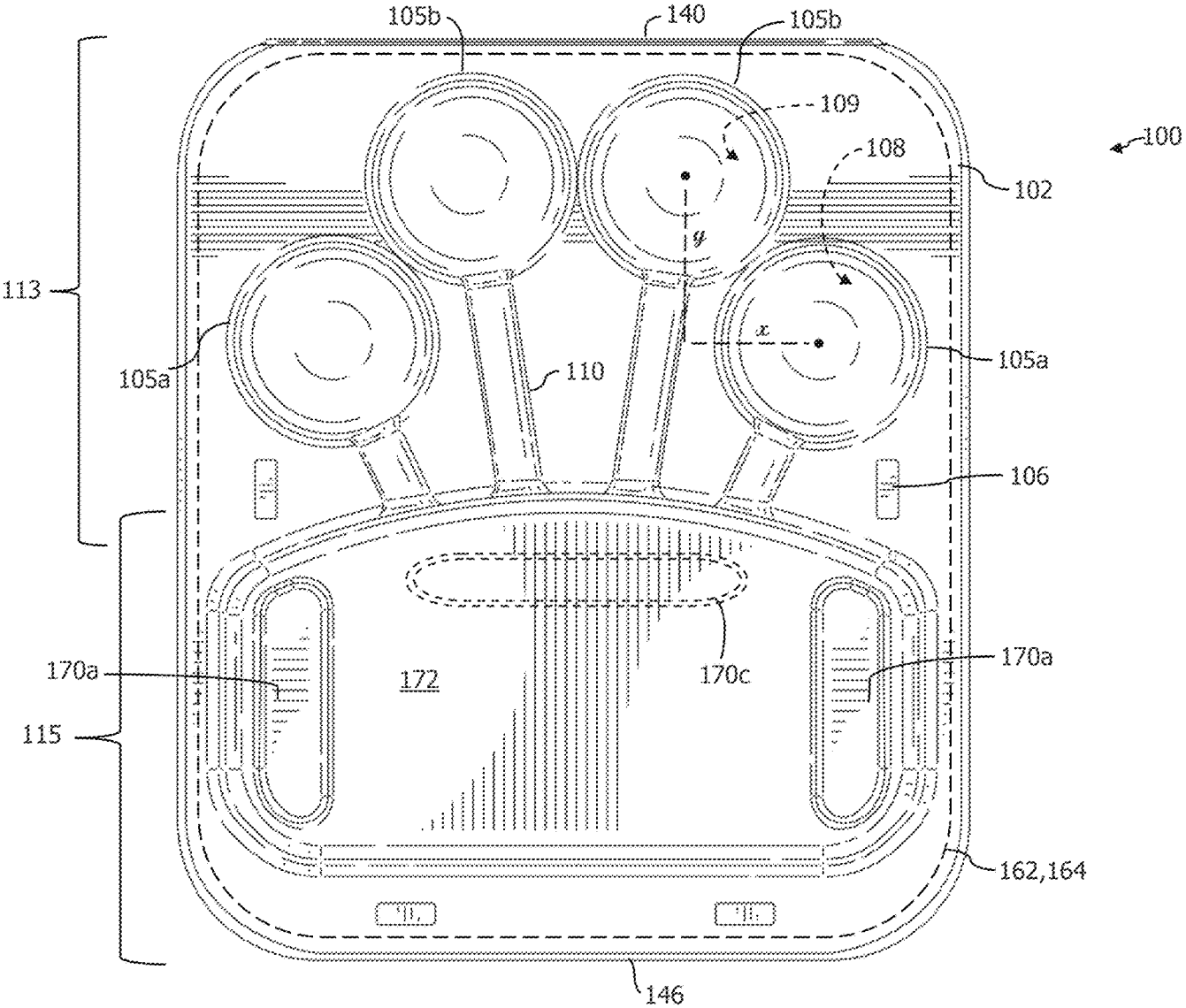
FIG. 3 is a front plan view of the container of FIG. 1

Still referring to FIGS. 1-5, the upper 102 has a sheet portion 118 that can be generally described as having a cake pop portion 113 and a unitary cavity portion 115 as labeled in FIG. 3. The sheet portion 118 surrounds cake pop-shaped surfaces 150 in the cake pop portion 113. The cake pop-shaped surfaces 150 define the upper portion of the cake pop-shaped receiving cavities 105. Likewise, the lower 104 has a sheet portion 119 that can be generally described as having a cake pop portion 113 and a unitary cavity portion 115 as labeled in FIG. 3. The sheet portion 119 surrounds cake pop-shaped surfaces 151 in the cake pop portion 113. The cake pop-shaped surfaces 151 define the lower portion of the cake pop-shaped receiving cavities 105.

Figure 4:
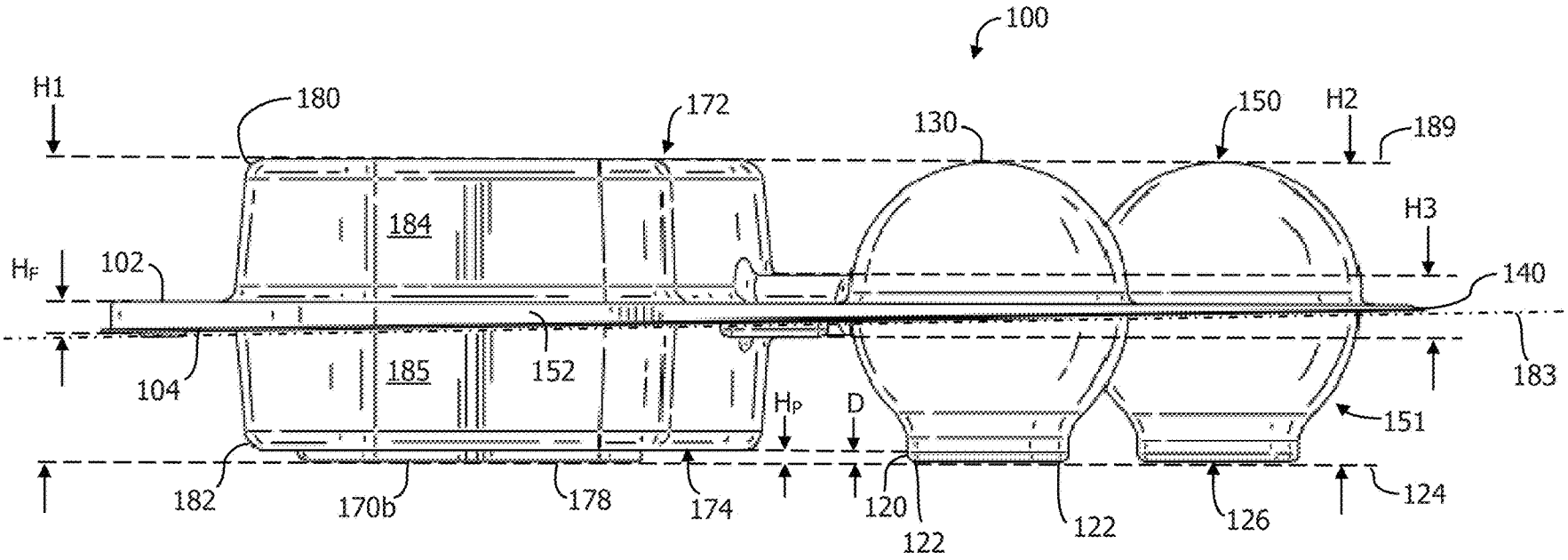
FIG. 4 is a right-side view of the container of FIG. 1.

Referring now to FIGS. 2 and 4, the sheet portions 118, 119 each extend around the unitary cavity portion 113 as well. Each unitary cavity segment 114*a*, 114*b* is a protrusion 180, 182, respectively, extending from its respective sheet portion 118, 119 outward. Each protrusion 180, 182 has at least one wall 184, 185, respectively, oriented generally transverse to a plane 183 defined by the sheet portions 118, 119, respectively and a bottom 186, 187, respectively, extending from the side walls and oriented parallel to the plane 183.

Still referring to FIGS. 2 and 4, the sheet portion 118 of the upper 102 has a side flange 152 extending downward therefrom to surround at least one side of a sheet portion 119 of the lower 104 when in the mated position. In one embodiment as shown and labeled in FIG. 2, the side flange 152 can extend along the left side 154, the bottom side 156, and the right side 158 of the sheet portion 118. And, as best seen in FIG. 4, the side flange 152 can gradually taper, and increase in height $H_F$ along the length of the sheet portion 118, thereby having a generally triangular shape when viewed from a side plan view. In an embodiment where the sheet portions 118, 119 are circular or oval instead of generally square or rectangular, the side flange 152 will be a single flange extending around all or a portion of the circumference thereof. In one embodiment, the side flange may extend around 180 degrees or more of the sheet portion or as much as up to a hinge portion if present.

Turning back to FIGS. 1-3, each cake pop-shaped cavity 105 is oriented at an angle relative to a central longitudinal axis A and positions the open end 112 of each stick receiving portion 110 closer to the central longitudinal axis A than a junction 113 of the stick receiving portion 110 with the cake receiving portion 108. The stick receiving portion 110 is a cylindrically shaped tube 116 having a length in a range of ½ inch to 2½ inch. As labeled in FIG. 3, at least one of the plurality of cake pop-shaped cavities 105*a* has the cake receiving portion 108 thereof positioned offset from an immediately neighboring cake receiving portion 109 of another of the plurality of cake pop-shaped cavities 105*b* in two dimensions, x and y. Still referring to FIG. 3, the container 100 has at least two cake pop-shaped cavities 105*b* that are mirror images of one another relative to the central longitudinal axis A. As illustrated in FIG. 3, the container 100 can have at least two pair of cake pop-shaped cavities 105*a*, 105*b* that are mirror images, respectively, of one another relative to the central longitudinal axis A. While the figures are presented with four cake pop-shaped cavities, in other embodiments, there can be any number such as 5, 6, 7, 8, 9, 10, 11, 12, etc.

Figure 15:
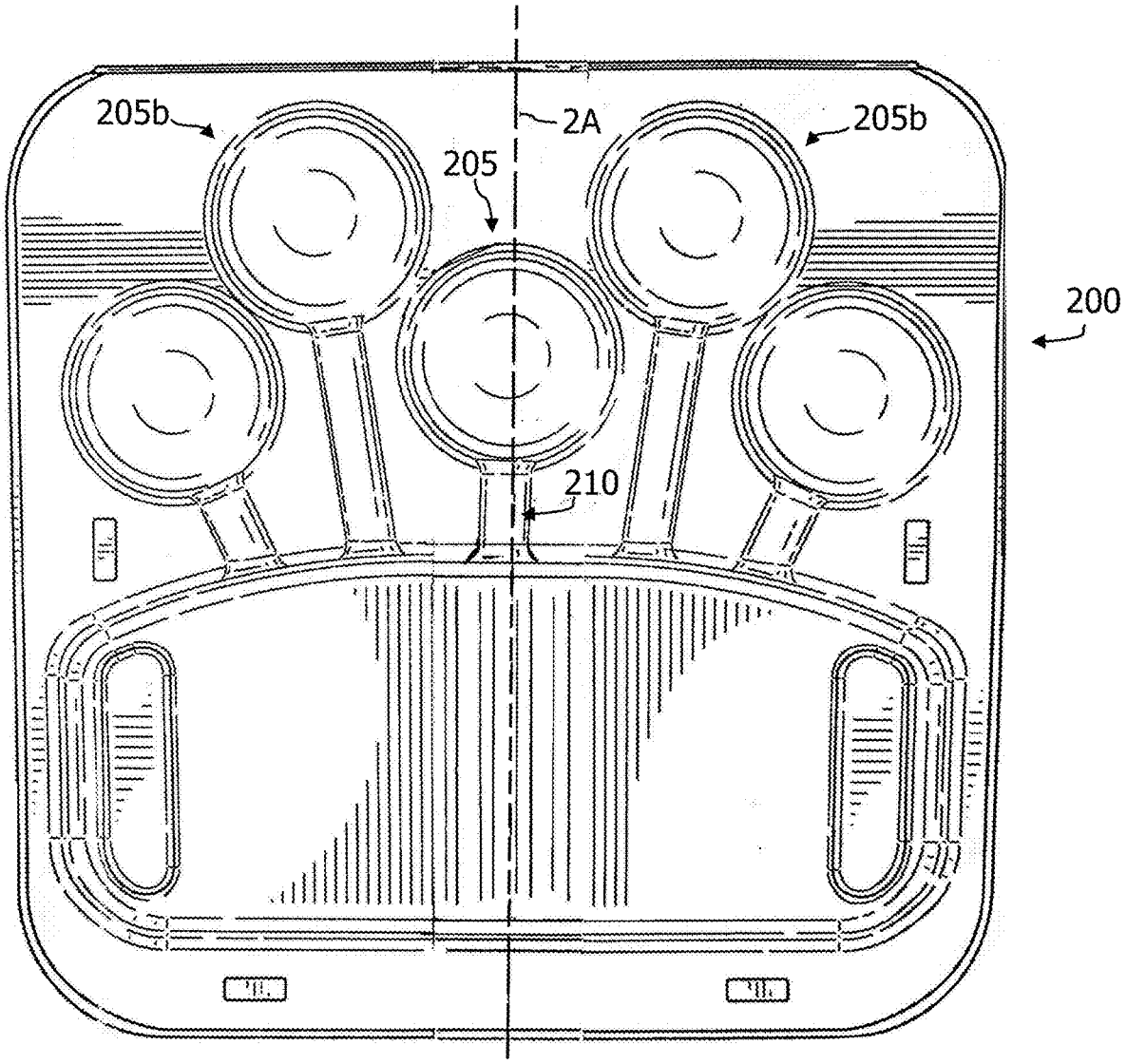
FIG. 15 is a front plan view of a third embodiment of a container for holding five cake pops.
Figure 16:
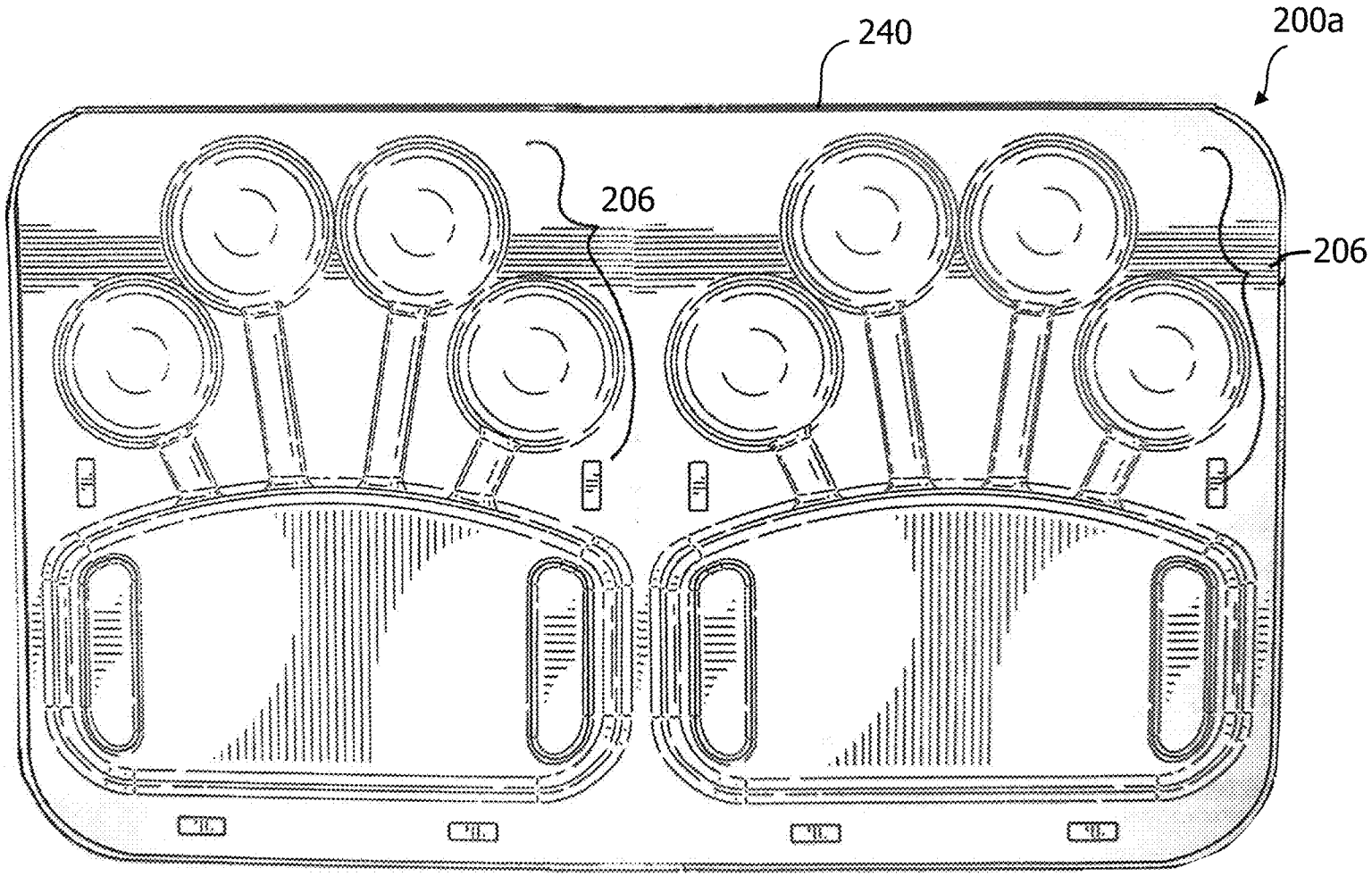
FIG. 16 is a front plan view of a fourth embodiment of a container having a first configuration for holding eight cake pops.
Figure 17:
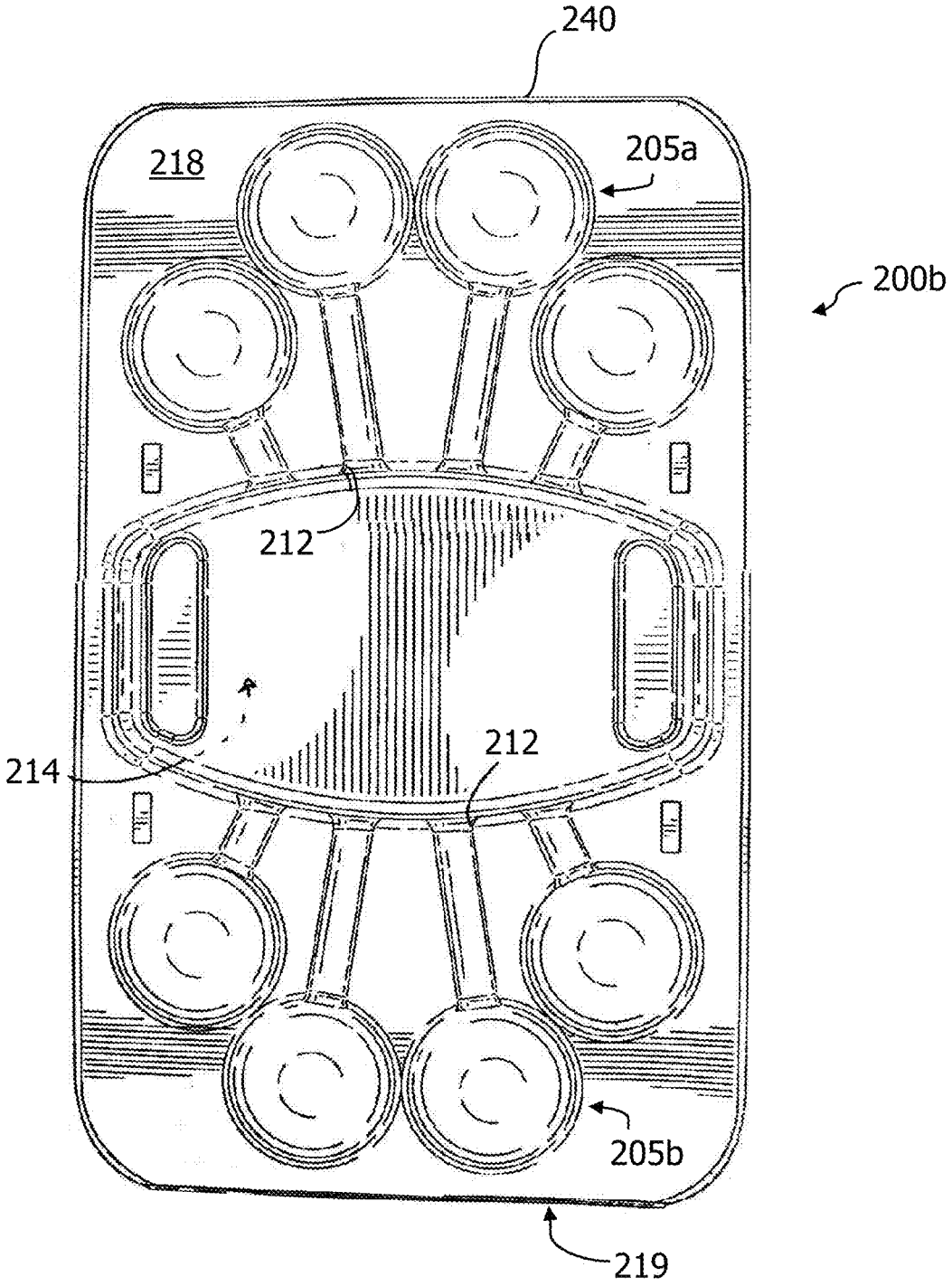
FIG. 17 is a front plan view of a fifth embodiment of a container having a second configuration for holding eight cake pops.

Referring now to FIG. 15, for five cake pops, the container 200 can be modified to add a central cake pop-shaped cavity 205 aligned with the central longitudinal axis 2A and being positioned below cake pop-shaped cavities 105*b* (FIG. 3), labeled as 205 b in FIG. 15, thereby moving the cake pop-shaped cavities as illustrated in the drawings for container 100 further apart from one another. Alternately, the central cake pop-shaped cavity 205 could have a longer stick receiving portion 210 to position the cake receiving portion above the cake pop-shaped cavities 205*b*. Referring to FIG. 16, the container 200*a* has the plurality of cake pop-shaped cavities 205 present in series as a set of duplicates of the configuration of four 206 arranged juxtaposed and integral with the left side 142 or the right side 144 of the sheet portions of FIGS. 1-5 and sharing a common hinge 240. In another embodiment, the series includes a third set of the configuration of four 206 cake pop cavities to provide a dozen cake pop cavities in total. Referring to FIG. 17, for eight cake pops, the container 200*b* can have a loner sheet portion 218, 219 having a second set of four cake pop-shaped cavities 205*b* having a stick end 212 terminating into the same unitary cavity 214 opposite the first set of four sake pop-shaped cavities 205*a*. All other features of container 200, 200*a*, and 200*b* are as described for container 100.

Figure 9:
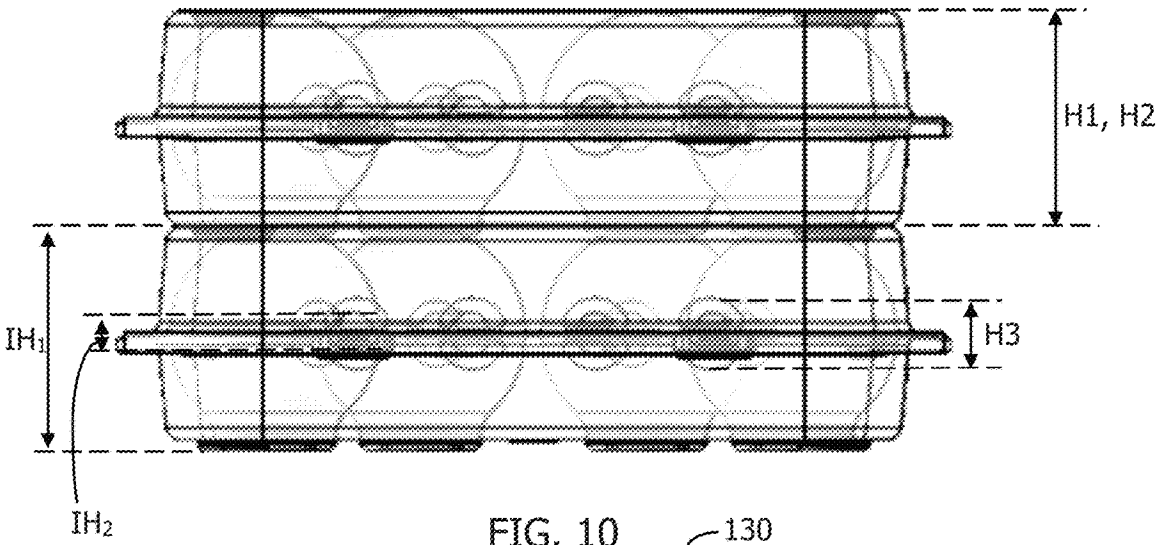
FIG. 9 is a bottom view of two containers according to FIG. 1 stack one on top of the other using retention features thereof.
Figure 10:
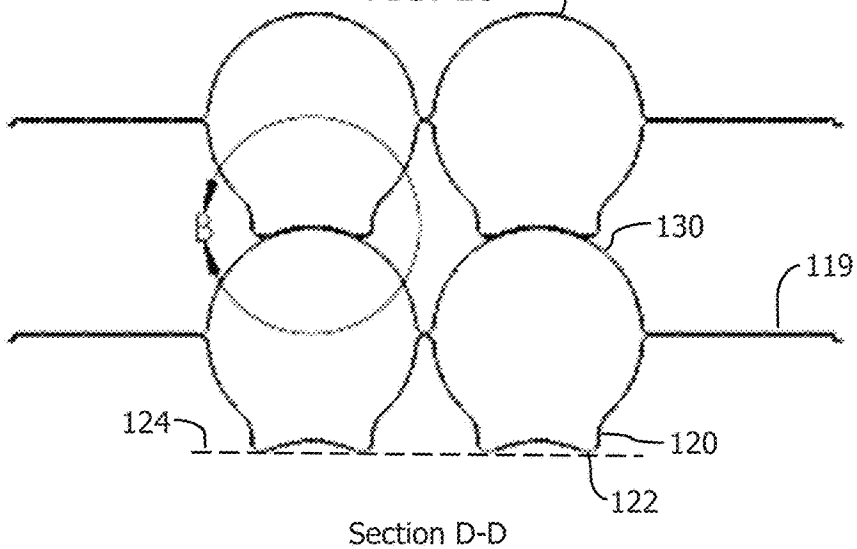
FIG. 10 is a line drawing illustrating the nesting of a first retention feature that is part of each of the spherically shaped compartments for the cake portion of the cake pops taken along line D-D in FIG. 5.

Referring to FIGS. 2 and 9-13B, each cake receiving portion 110*b* of the lower 104 has a base 120 protruding away from the sheet portion 119 of the lower and having a first exterior surface 122 defining a plane 124 lying parallel to a sheet portion 119 of the lower 104 and in surrounding relationship to a second exterior surface 126 contoured inward toward the cake pop-shaped cavity 105. The second exterior surface's contour is shaped to match an outermost exterior surface 130 of the cake-receiving portion 110*a* of the upper 102 to provide a first nesting feature for stacking the containers 100 as shown in FIG. 9. In the embodiments shown in the figures and labeled in FIGS. 10 and 11, the first exterior surface 122 is in the shape of an annular ring and the second exterior surface 126 is a concave as viewed in a transverse cross-section and in a longitudinal cross-section, i.e., it forms dome shaped to mate with the spherical outermost exterior surface 130 of the upper 102. While spherical shapes and surfaces are used herein because the cake pop C (FIGS. 5-7) are spherical, the invention is not limited thereto. If the cake pop was square, a square or rectangular base defining two exterior surfaces in the same manner described above can form a nesting feature for receiving an outermost exterior surface of the cake receiving portion of the upper.

Figure 11:
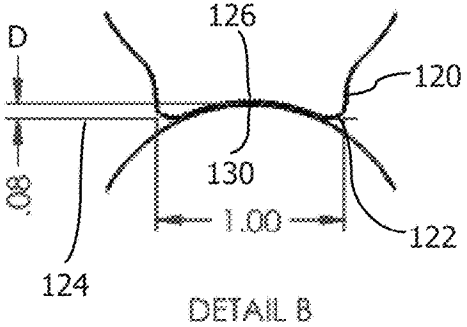
FIG. 11 is an enlargement of detail B of FIG. 10 showing the depth of the nesting.

As shown in FIG. 11, the base 120 can have a diameter of one inch and the apex of the second exterior surface may be 0.08 inch deep. Alternately, as shown in FIGS. 12A and 12B the diameter can be smaller and the depth shallower. For example, the diameter can be 0.5 inch and depth can be 0.2 in to 0.4 in. Further, as shown in FIGS. 13A and 13B, the diameter can be larger and the depth deeper. For example, the diameter can be 1.25 to 1.5 inches and the depth can be 0.09 to 0.12 in. All dimensions are variable by commercially reasonable manufacturing and measuring tolerances.

A second nesting feature 170 for the nesting relationship between containers 100 is present in the opposing exterior surfaces 172, 174 of the unitary cavity 114 formed by the upper 102 and the lower 104, respectively. The nesting feature 170 includes one or more stacking receptacles 170*a* in the exterior surface 172 of the upper 102 and one or more mating protrusions 170*b* extending from the exterior surface 174 of the lower 104, the number of stacking receptacles and mating protrusion being equal. In another embodiment, the stacking receptacle(s) are in the exterior surface of the lower 104 and the mating protrusion(s) are part of the upper 102. Each mating protrusion 170*b* is shaped to seat in one respectively positioned stacking receptacle 170*a*. In the embodiment illustrated in the figures, two such nesting features 170 are present, one being proximate a left side of the exterior surface 172, 174 and the other being proximate a right side of the exterior surface 172, 174, respectively. However, as shown by the dashed stacking receptacle 170*c*, there can be a single, elongate stacking receptacle oriented transverse to the longitudinal axis. While this stacking receptacle 170*c*, is shown most proximate to the open end 112 of the stick receiving portion 110, it could be more centrally positioned in the exterior surface 172 of the unitary cavity 114 or more proximate the end 146 of the container 100. Further, the stacking receptacle 170*c* may be present in addition to the first stacking receptacle 170*a*, and if present the lower 104 will have an aligned mating protrusion (not shown).

Turning now to FIGS. 4 and 10-12, still relevant to the nesting relationship of at least two containers, the unitary cavity has an exterior height H1 more proximate to or the same as the exterior height H2 of the cake receiving portion 108 than an exterior height H3 of the stick receiving portion, and the protrusion height $H_P$ of the mating protrusion 170*b* is equal to the depth D of the second exterior surface 126 of the base 120 of the cake receiving portion. Here, the upper 102 has a sheet portion 118 lying in a first plane 183 and has an outer plane 189 parallel to the first plane that includes an outermost point of each domed exterior surface 130 of each of the plurality of cake receiving portions 108 and the lower 104 has a sheet portion 119 mated to the sheet portion 118 and an opposing outer plane 124 parallel to the first plane that includes the exterior surface 178 of the stacking feature 170*b* of the unitary cavity 114.

The mating means 106 can be any type of fastener, adhesive tape or an adhesive label (represented by the dashed shape 160 in FIG. 1), plastic weld (represented by the dashed shape 162 in FIG. 3), a shrink wrap band (represented by the dashed shape 164 in FIG. 3) or cover, or a combination thereof. The fastener can be a snap-fit detent 106*a* in the upper 102 and a mating receptacle 106*b* in the lower 104 (or vice versa) as shown in the figures, a snap-fit or friction fit mating flanges, a deformable flange on either of the upper or the lower that can be deformed on to the respective other of the upper and lower, one or more depressible tabs, and combinations thereof.

Referring now to FIGS. 5-8, the cake receiving portion 108 of the cake pop-shaped cavity 105 has a clearance of between the exterior surface of the cake and the interior surface of the cake receiving portion 108*a*, 108*b*. The clearance is at least 0.05 in for $C_{C2}$ (FIG. 6) but can be up to 0.1 in for $C_{C1}$ (FIG. 7), depending upon whether the cake has any external adornments. With reference to FIG. 8, the cylindrical tube 116 defining the stick receiving portion 110 has a clearance $C_S$ between a stick of a cake pop and the interior surface thereof. This clearance is at least 0.1 in.

Figure 18:
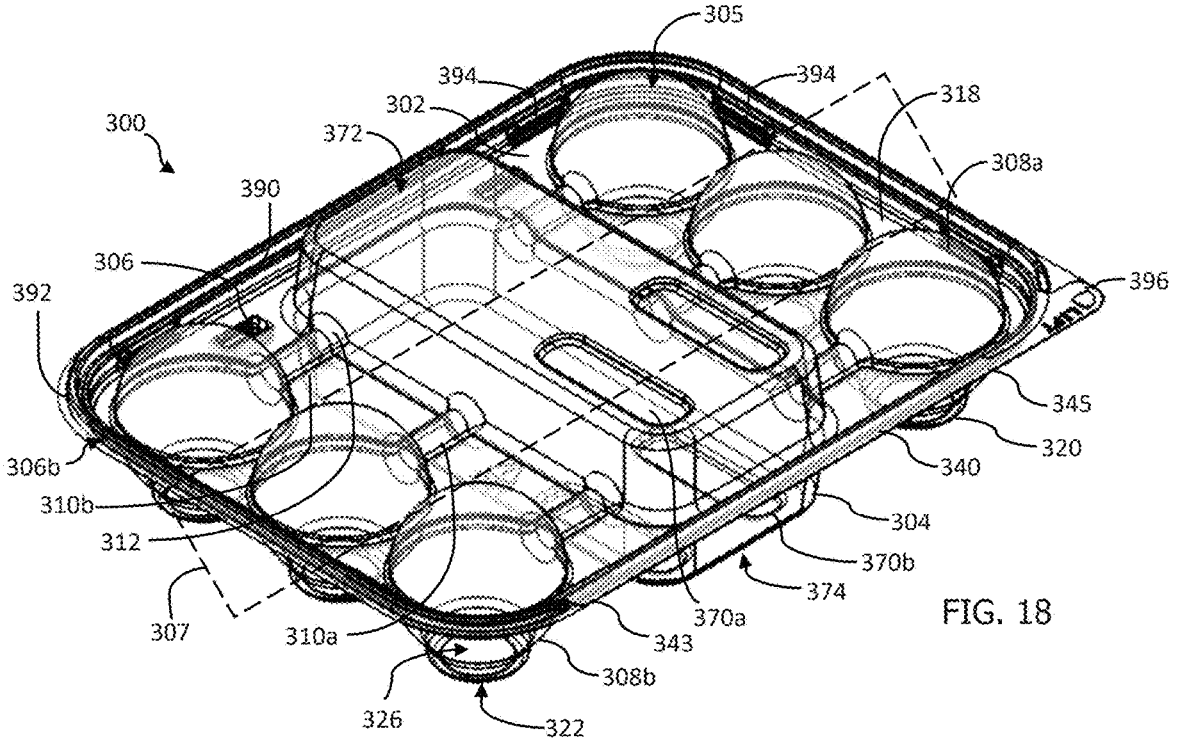
FIG. 18 is a front perspective view of a sixth embodiment of a closed container for six cake pops.
Figure 19:
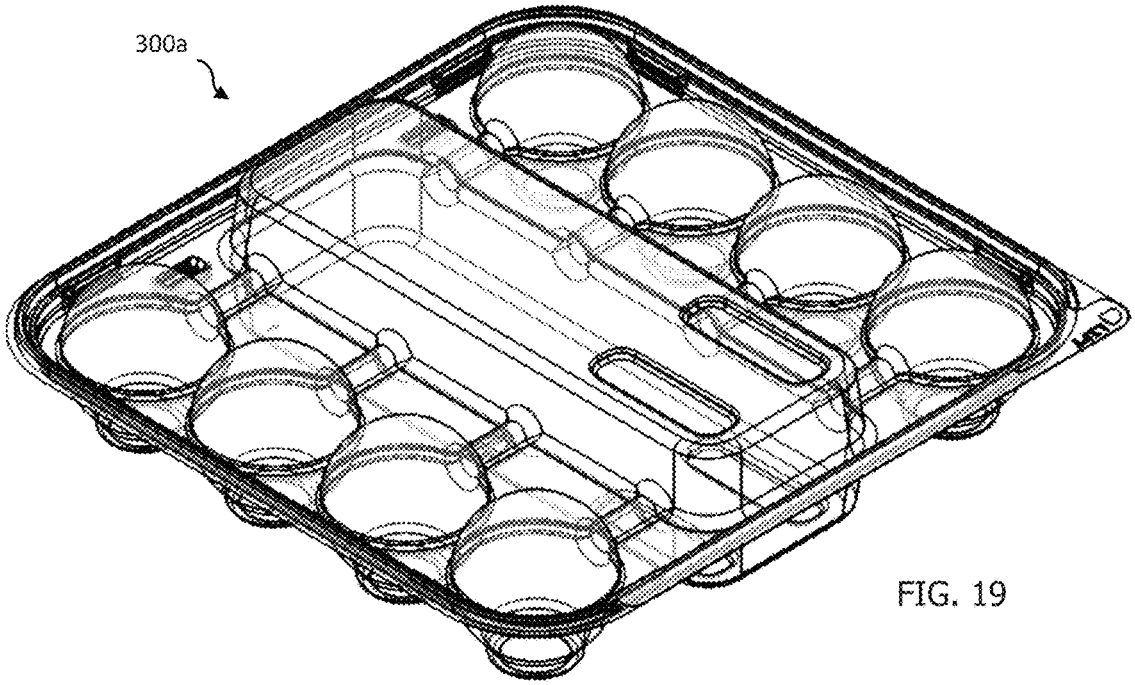
FIG. 19 is a front perspective view of a sixth embodiment of a closed container for eight cake pops.
Figure 20:
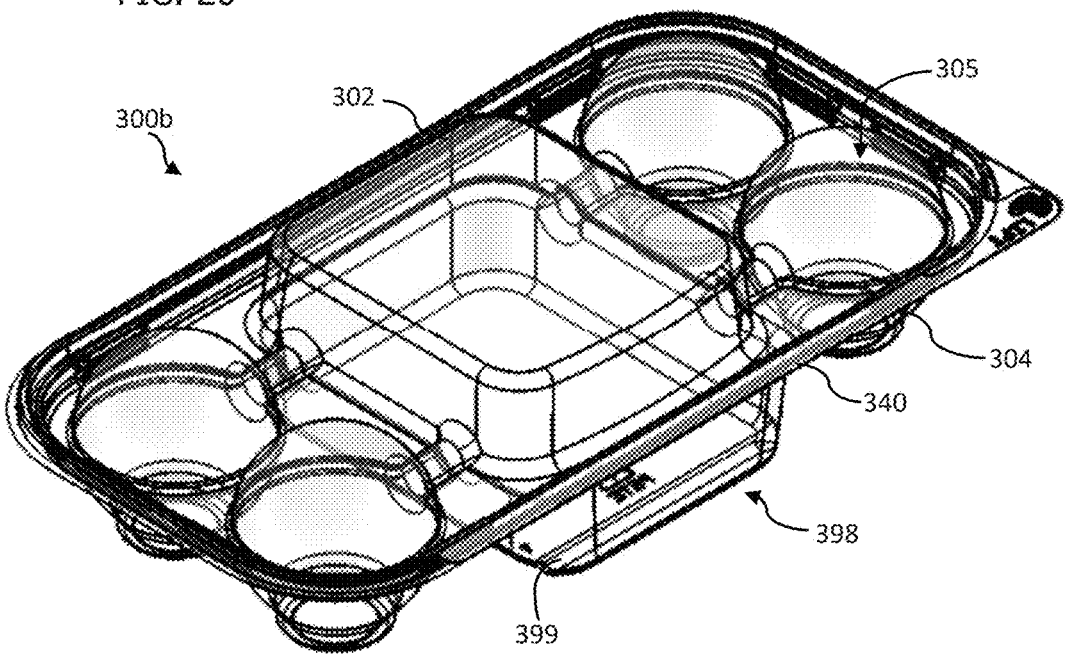
FIG. 20 is a front perspective view of a seventh embodiment of a closed container for eight cake pops.
Figure 21:
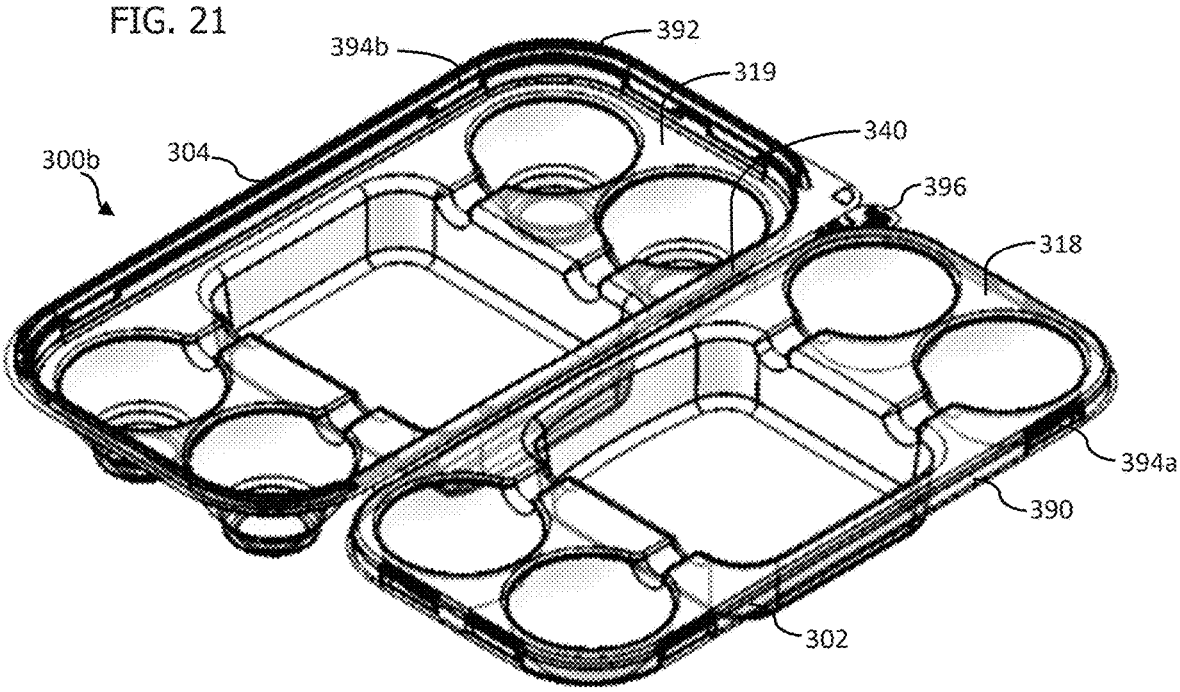
FIG. 21 is a top perspective view of the seventh embodiment in an open position.

Referring now to FIGS. 18-20, three additional embodiments of cake pop containers are shown, generally designated as reference 300, 300*a*, 300*b*, respectively. Each container 300 includes many of the same features described above with respect to the other embodiments and when labeled in these figures will be numbered the same except for beginning with 300. The container 300 has an upper 302 and a lower 304 that are mateable to one another to form the closed positions shown in FIGS. 18-20 which defines a plurality of cake pop-shaped cavities 305. Each cake pop-shaped cavity 305 has a cake receiving portion 308 (308*a* in the upper and 308*b* in the lower) and a stick receiving portion 310 (310*a* in the upper and 310*b* in the lower). Each stick receiving portion 310, in mated form, terminates with a terminal, open end 312 into the unitary cavity 314. Each stick receiving portion can have a length as discussed above. In some embodiments the length of each stick receiving portion is one-half an inch. The unitary cavity 314 has an internal height that is greater than an internal height of the stick receiving portion, such that a free end of a stick of each of a plurality of cake pops is suspended therein in an unsupported manner as shown in FIG. 5. The container of FIG. 18 has six cake pop-shaped cavities 305 arranged as mirror image pairs, exemplified by the dashed box around one mirror image pair 307, set in three rows. The container of FIG. 19 has eight cake pop-shaped cavities 305 arranged as mirror image pairs set in four rows. The container of FIG. 20 has four cake pop-shaped cavities arranged as mirror image pairs set in two rows. Each mirror image pair 307 has the respective stick receiving portions 310 aligned with their respective terminal ends 312 facing one another, thereby the cake pop sticks will be aligned and point toward one another in the unitary cavity 314.

Still referring to FIGS. 18-20, the upper and lower can be connected by a hinge 340. In the embodiments as illustrated, each mirror image pair 307 lies parallel to the hinge 340 and the unitary cavity has a length the is perpendicular to the hinge 340. The exterior surface 372 of the unitary cavity defined by the upper 302 can include a first stacking feature 370*a*, and the exterior surface 274 of the unitary cavity defined by the lower 304 can include a second stacking feature 370*b*. One of the first or second stacking feature 370, 370*b* is a trough in the respective exterior surface 372, 274 and the other is a crest or protrusion in the other exterior surface 372, 274. The trough and crest are shaped to be mateable when one container is stacked on top of another container. These stacking features 370 can be arranged perpendicular to the hinge 340, parallel to the hinge 340, or at an angle relative to the hinge 340.

Additionally, each container, 300, 300*a*, and 300*b* includes a stacking feature as part of the cake receiving portion 308 of the cake pop-shaped cavities 305. Each cake receiving portion 308*b* of the lower 304 has a base 320 protruding away from the sheet portion 319. The base 320 has a first exterior surface 322 defining a first plane lying parallel to the sheet portion 319 and a second exterior surface 326 contoured inward and having a shape to match an exterior, outermost surface 330 of the cake-receiving portion 308*a* of an upper 302. The first exterior surface 322 has a surrounding relationship relative to the second exterior surface 326, which can be an inverted dome surface. The inverted dome surface is mateable for stacking on a spherical exterior surface of the cake pop receiving portion 308*a* of an independent container's upper 302. Also see the description above for FIGS. 9-13*b*.

Figure 22:
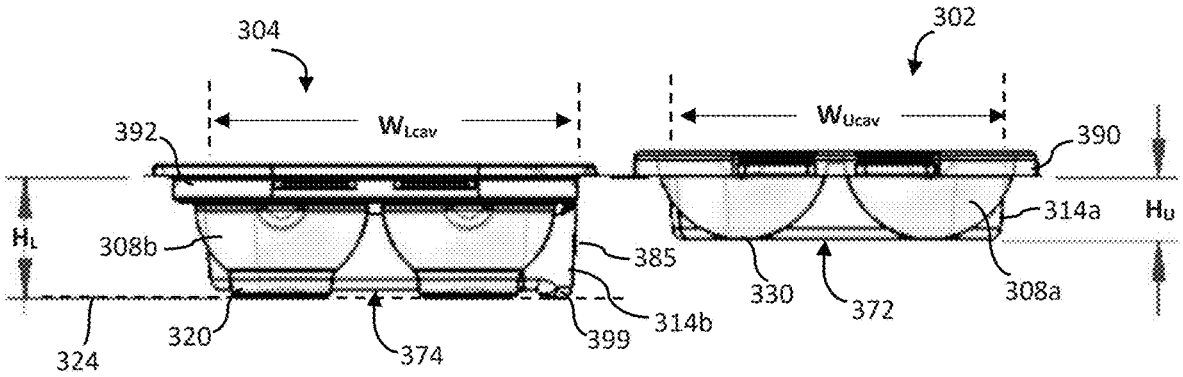
FIG. 22 is a plan side view of the seventh embodiment from one of the cake pop receiving ends.

FIG. 20 demonstrates another type of stacking feature 398. With reference to FIGS. 20 and 22, the unitary cavity segment 314*b* of the lower 304 comprises a stacking flange 399 extending along one wall 385 or a portion of a wall of the unitary cavity and protruding outward and terminating flush with the outer plane 324 of the lower 304. The stacking flange 399 is contoured to sit in registration on a surface of a respective unitary cavity segment 314*a* of a separate container for cake pops. As best seen in FIG. 22, the unitary cavity segment 314*b* of the lower is positioned to, when seated on the unitary cavity segment 314*a* of an upper 302, extend over a portion of a wall of the unitary cavity segment 314*a*. This is possible because the unitary cavity segment 314*b* of the lower 304 has a width ($W_{Lcav}$) that is wider than the width ($W_{Ucav}$) of the unitary cavity segment 314*a* of the upper 302. The contour of the stacking flange's interior surface may be generally concave along its length.

Still referring to FIGS. 18-20, the containers 300 include mating means 306*a* and 306*b*. The mating means 306 can be any of those discussed above. In these embodiments, it is a combination of a press-fit detent and receptacle formed in the sheet portions 318, 319 and a perimeter flange 390 of the upper 302 and a mating perimeter flange 392 of the lower 304 (or vice versa). The perimeter flange 390 and mating perimeter flange 392 can include one or more snap-fit or press-fit connectors 394. The perimeter flanges 390, 392 each begin proximate one end 343 of the hinge 340 and terminate at a proximate a tab 396 near the second end 345 of the hinge. The tab 396 is useful for opening the container 300, i.e., separating the upper and lower from one another and can include a seal that must be broken during the opening process.

Figure 23:
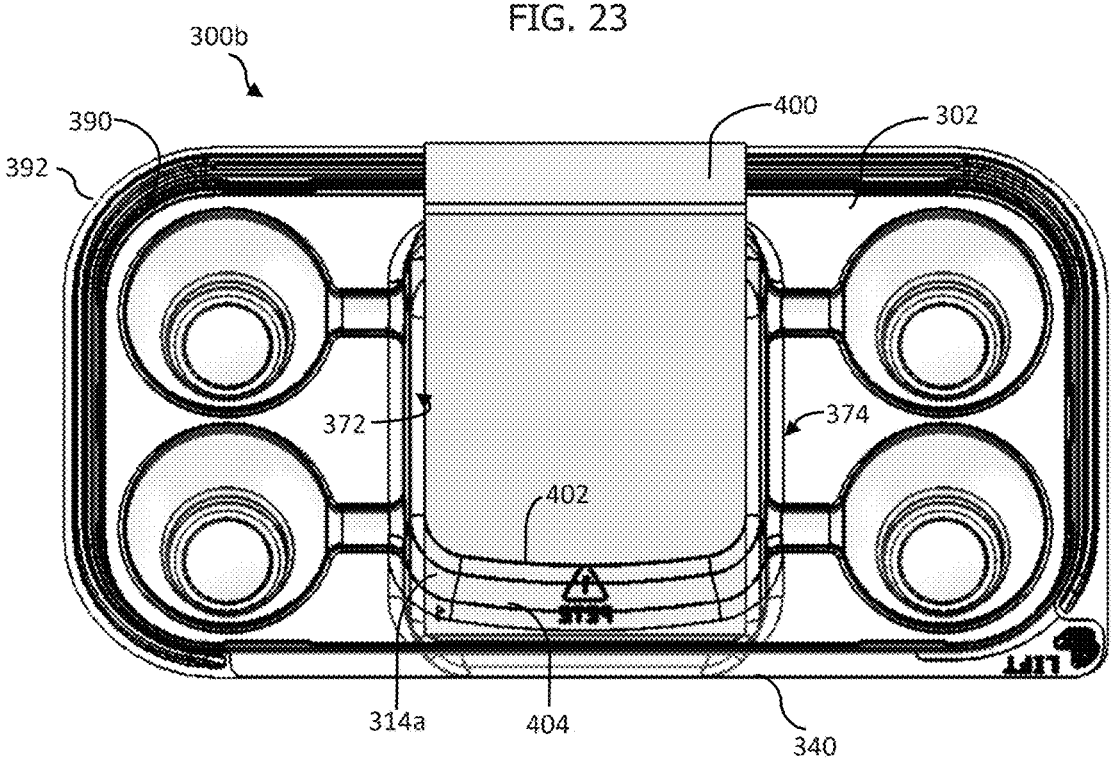
FIG. 23 is a front perspective view of the seventh embodiment with an adhesive label on the exterior surface of the unitary cavity.

Turning now to FIG. 23, the cake pop container 300*b* includes an adhesive label 400 as an additional mating means. The first end 402 of the adhesive label 400 is present on the exterior surface 372 of the unitary cavity segment 314*a* of the upper 302 and extends away from the hinge 340, cover the mated flanges 390, 392, and onto the exterior surface 174 of the unitary cavity segment 314*b* of the lower 304. The second end 404 of the adhesive label 400 can extend paste the first end of label 402.

Figure 24:
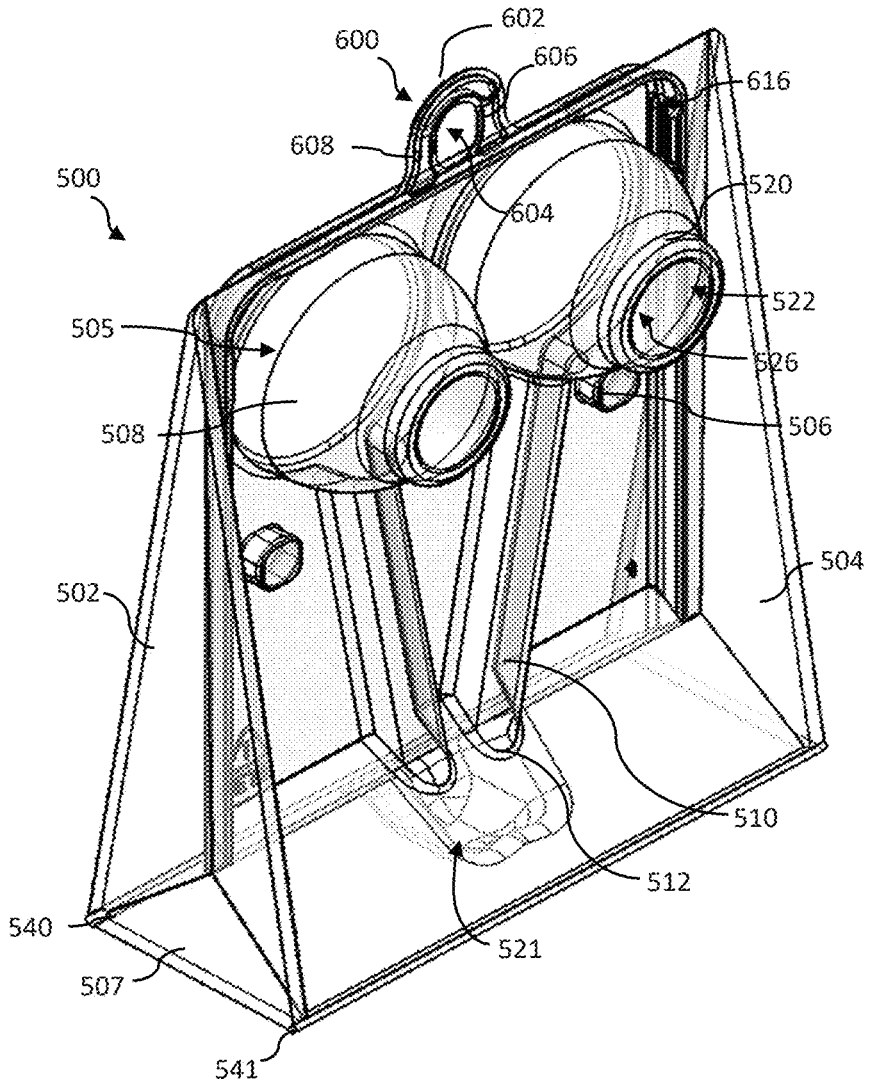
FIG. 24 is a rear perspective view of an eight embodiment of a closed container for two cake pops.
Figure 25:
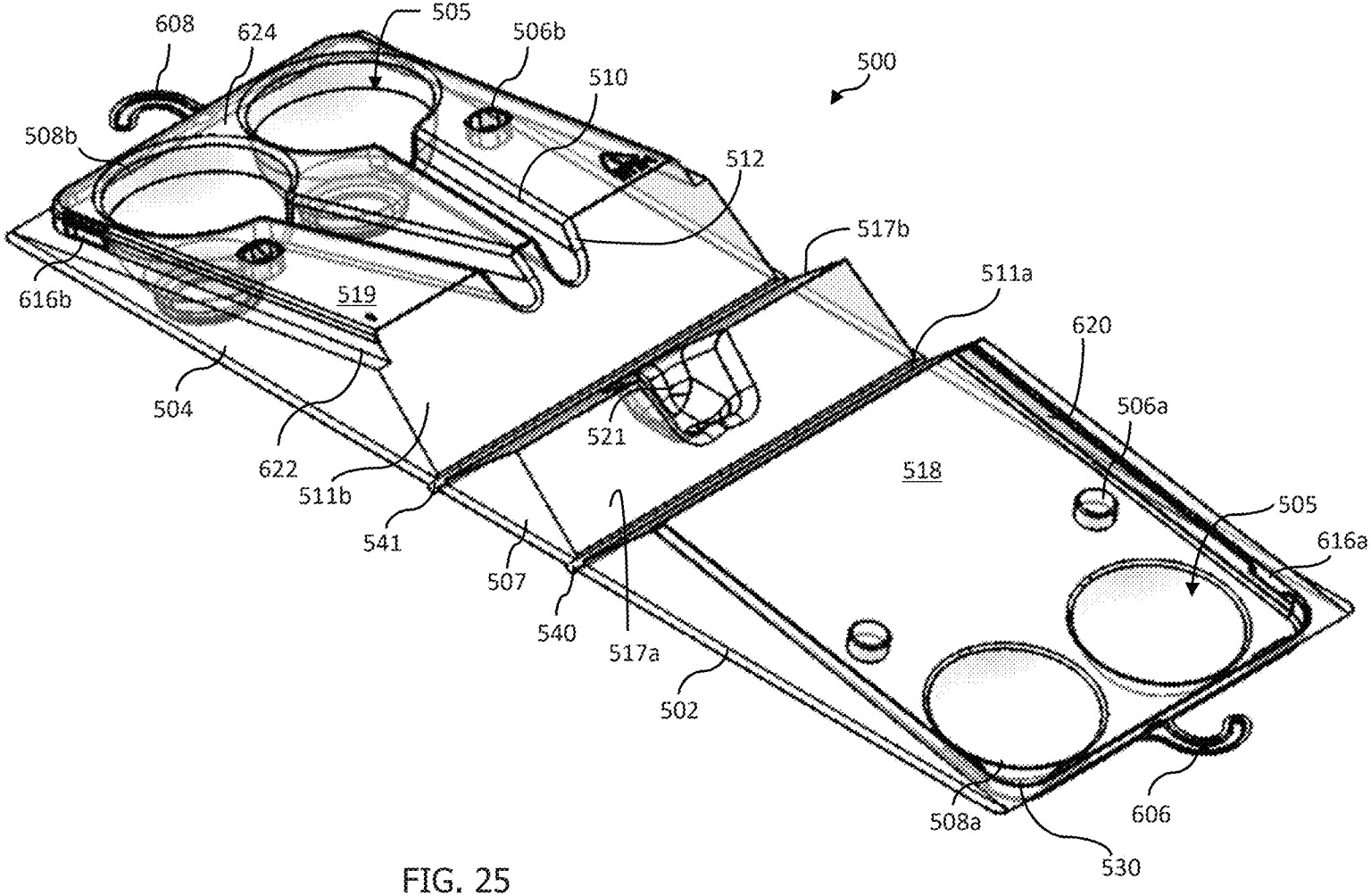
FIG. 25 is top perspective view of the eight embodiment in an open position.

Turning now to FIGS. 24 and 25, another embodiment for a cake-pop container 500 is presented and is designated as reference 500. Container 500 includes many of the same features described above with respect to the other embodiments and when labeled in these figures will be numbered the same except for beginning with 500. The container 500 has an upper 502 and a lower 504 that are mateable to one another to form a closed position, shown in FIG. 24, which defines a plurality of cake pop-shaped cavities 505. In this embodiment, the upper 502 and the lower 504 are each hingedly connected to a triangular prism-shaped base 507. In the closed position the upper 502 and the lower 504 each have an angled surface 511*a*, 511*b*, respectively, seated with respect to a first elongate side 517*a* and a second elongate side 517*b* of the base 507. These surfaces are labeled in FIG. 25. Each cake pop-shaped cavities 505 has a cake receiving portion 508 and a stick receiving portion 510, and each cake receiving portion 508*b* of the lower 504 has a base 520 having a first exterior surface 522 defining a first plane that includes the hinge 541 that couples the lower 504 to the triangular prism-shaped base 507 and a second exterior surface 526 contoured inward and having a shape to match an exterior surface 530 of the cake-receiving portion 508*a* of the upper 502. In the illustrated embodiments, the second exterior surface 526 is an inverted dome surface mateable for stacking on a spherical exterior surface 530 of a cake-receiving portion 508*a* of a non-mated upper, i.e., one on a separate container.

Still referring to FIGS. 24 and 25, the lower 504 comprises at least a first pair of cake receiving portions 508*b* and corresponding stick receiving portions 510. The upper 502 has an aligned pair of cake receiving portions 508*a*, but optionally no stick receiving portions as shown in FIG. 25. As a result, the sheet portion 518 of the upper 502 has a flat exterior surface suitable for a label containing information about the cake pops. The pair of stick receiving portions 510 in the lower 504 are oriented with a terminal end 512 of each thereof angled toward one another. The triangular prism-shaped base 507 defines a recess 521 shaped to mate with the terminal ends 512 of the first pair of stick receiving portions 510. The recess 521 can be a unitary cavity as shown in FIG. 25 or can be subdivided to a number of chambers equal to the number of stick receiving portions (not shown).

The cake pop container of FIGS. 24 and 25 illustrates a hanging feature 600 that can be present on any of other cake pop containers. The hanging feature 600, with the upper 502 and the lower 504 mated in the closed position, forms a generally U-shaped tab 602 extending from the container opposite the triangular prism-shaped base 507 at an orientation that defines a through hole 604. As seen in FIG. 25, the upper 502 has a J-shaped tab 606 and the lower has a J-shaped tab 608 that mate to form the hanging feature 600. The two J-shaped tabs 606, 608 are oriented with their hooked end extending away from the respective upper and lower 502, 504 and with the concave surface of each of the hooked ends facing one another.

The cake pop container 500 includes mating means 506, 616. One of the mating means is a detent 506*a* and receptacle 506*b* as described above and present in the sheet portions 518, 519 of the upper and lower, respectively. A second mating means 616 is a snap-fit protrusion 616*a* in the upper 502 and a receiving recess 616*b* in the lower 504, or vice versa. The snap-fit protrusion 616*a* can protrude inward toward the center of the sheet portion 518 of the upper from a flange 620 that protrudes toward the lower 504 in the closed position. The receiving recess 616*b* of the lower 504 faces the snap-fit protrusion 616*a* and is in a side wall 622 of a raised section 624 of the sheet portion 519 of the lower 504.

Figure 26:
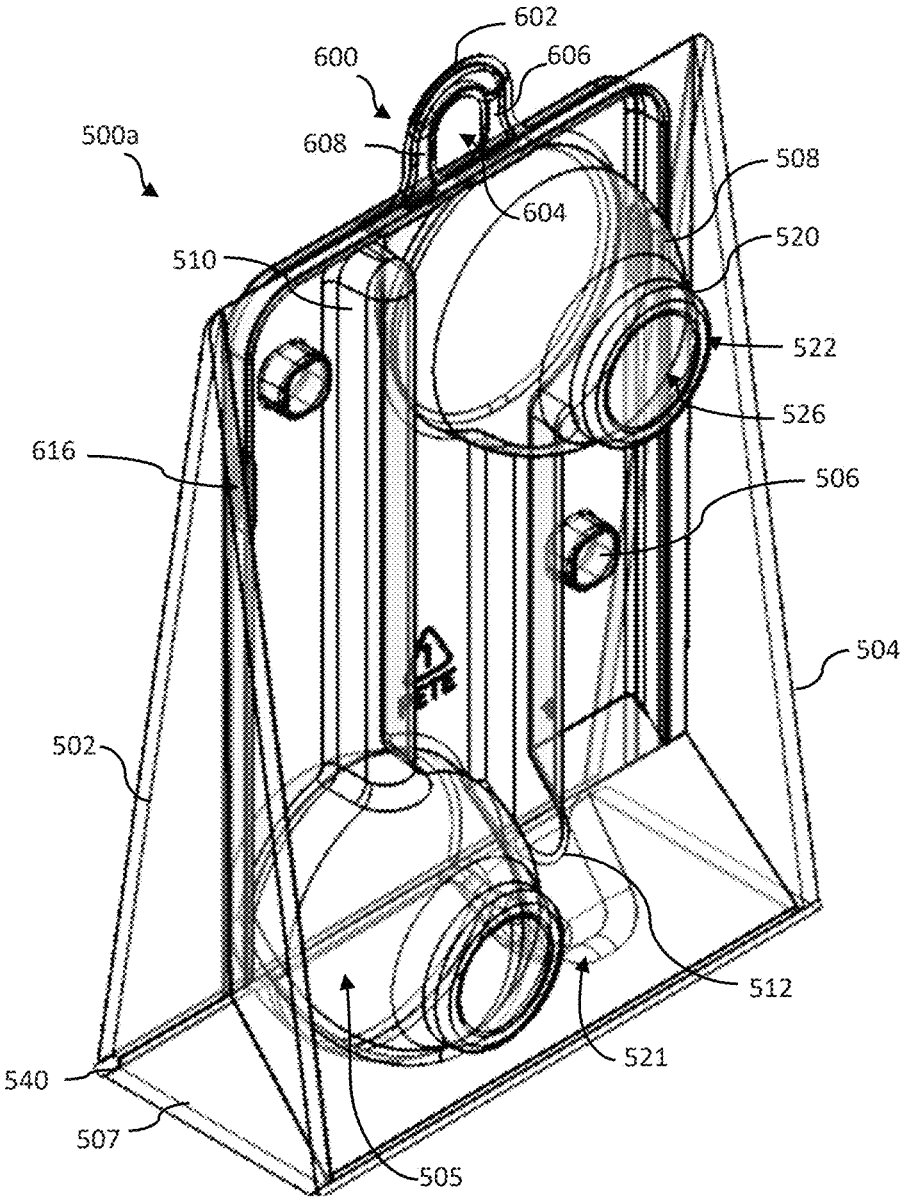
FIG. 26 is a rear perspective view of a ninth embodiment of a closed container for two cake pops.
Figure 27:
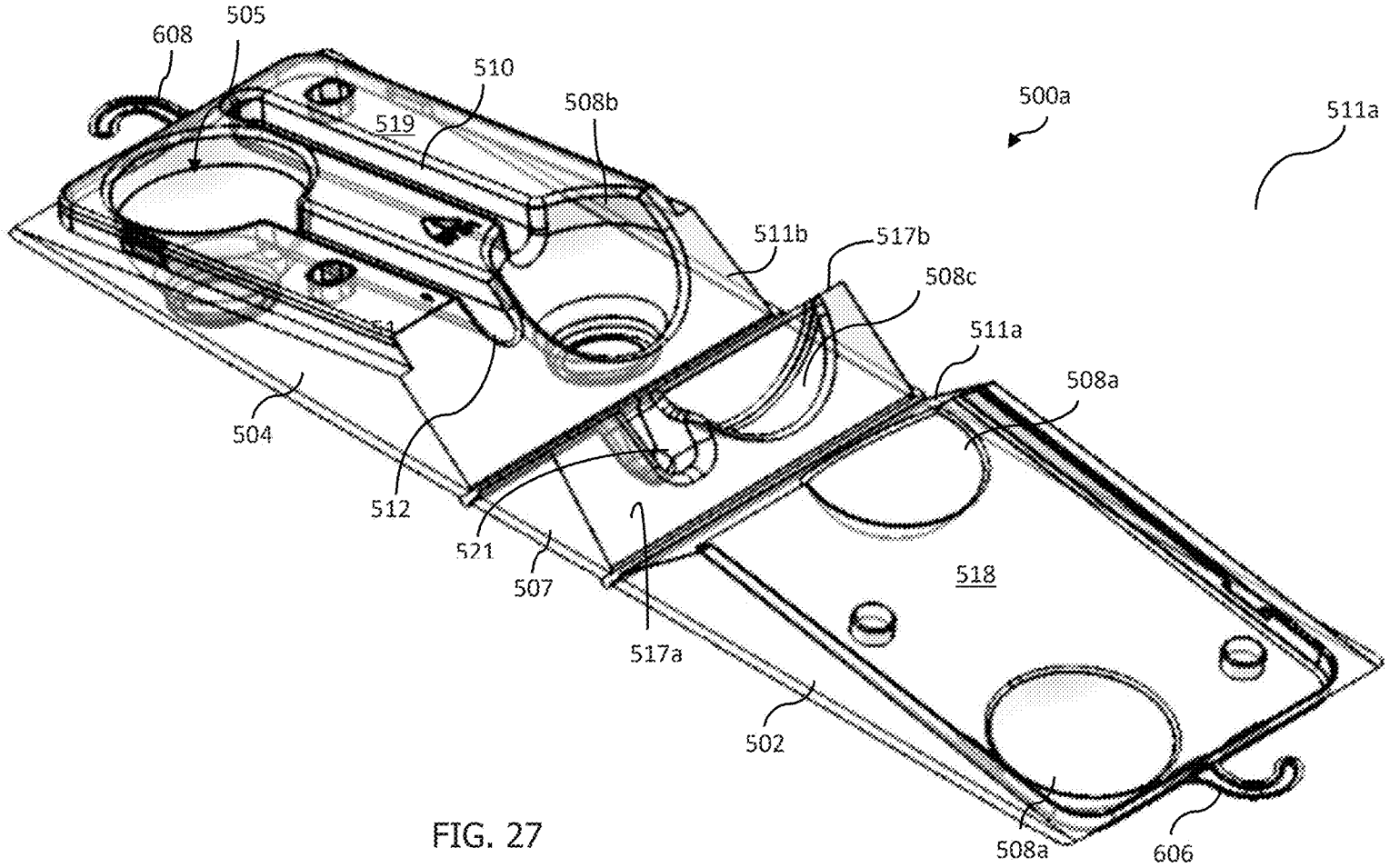
FIG. 27 is top perspective view of the ninth embodiment in an open position.

Turning now to FIGS. 26 and 27, a cake pop container generally designated as 500*a* is provided. This cake pop container 500*a* is similar to the container of FIGS. 24 and 25 and includes like reference numbers for the same or similar features, as such those features will not be redescribed here. The primary difference is the orientation of the cake pop-shaped cavities 505. Here, the two cake pop-shaped cavities 505 are oriented side-by-side with the cake receiving portions 508 pointed in opposite directions with the stick receiving portions 510 lying parallel to one another. The triangular prism-shaped base 507 defines a portion 508*c* of a first of the cake receiving portions 508 and has a recess 521 shaped to mate with one terminal end 512 of a stick receiving portion 510 of the other cake pop-shaped cavity. As such, both the upper 502 and the lower 504 have the cake pop receiving portions 508*a*, 508*b*, respectively, of the first cake receiving portion 508 cut and open at an angle that is aligned with the respective surface 511*a*, 511*b*.

The containers disclosed herein provide multiple advantages. The container is quickly manufactured using a molding process. The plastic material selected is of a gauge of thickness that protects the cake pop from being crushed during shipping and handling. The containers are configured to allow the cake pops to be stored, frozen, and shipped with the cake pops oriented horizontally relative to the ground and stacked in nesting relationship with one another in said orientation. This enables the cake pops to be shipped in multiples per box and multiple boxes per pallet without damage to the cake, and yet provides a pleasant display thereof in a store. The container enables the cake pops to be displayed in their horizontal stacked orientation or, because of the sheet portion surrounding the unitary cavity, to be displayed upright by inserting the bottom of the sheet portion of the container into a slit in a display device, for example a cardboard box, foam or Styrofoam display. Further, the construction of the cylindrical tube of the stick receiving portion, while having a clearance that allows the stick to wiggle therein to absorb vibrations during shipping and handling, does not allow the stick to slip out of the tube, e.g., the stick will not end up between the sheet portion of the upper and the lower during shipping and handling. Also, the unitary cavity provides an exterior surface of suitable size for a label and for handling. The unitary cavity is more prominent in size than the sake receiving portion, rendering it desirable and easy to grab in hand, thereby further protecting the cake from damage.

It should be noted that the embodiments are not limited in their application or use to the details of construction and arrangement of parts and steps illustrated in the drawings and description. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention.

Having described the invention in detail and by reference to various embodiments thereof, it will be apparent that modifications and variations are possible without departing from the scope of the invention which is defined in the appended claims.

What is claimed is:

1. A container for cake pops comprising:

an upper and a lower each hingedly connected to a triangular prism-shaped base, wherein in a closed position the upper and the lower each have an angled surface seated with respect to a first elongate side and a second elongate side of the triangular prism-shaped base, respectively, and are mateable to one another to define a plurality of cake pop-shaped cavities each having a cake receiving portion and a stick receiving portion, wherein each cake receiving portion of the lower has a base having a first exterior surface defining a first plane that includes a first hinge that couples the lower to the triangular prism-shaped base and having a second exterior surface contoured inward and having a shape to match an exterior surface of the cake-receiving portion of the upper;

wherein the plurality of cake pop-shaped cavities are oriented side-by-side with each having a cake receiving portion and the respective cake receiving portions thereof are pointed in opposite directions, and the triangular prism-shaped base cooperates with the upper and lower to define one of the cake receiving portions and the triangular prism-shaped base defines a recess shaped to mate with one terminal end of a stick receiving portion.

2. A container for cake pops comprising:

an upper and a lower each hingedly connected to a triangular prism-shaped base, wherein in a closed position the upper and the lower each have an angled surface seated with respect to a first elongate side and a second elongate side of the triangular prism-shaped base, respectively, and are mateable to one another to define a plurality of cake pop-shaped cavities each having a cake receiving portion and a stick receiving portion, wherein each cake receiving portion of the lower has a base having a first exterior surface defining a first plane that includes a first hinge that couples the lower to the triangular prism-shaped base and having a second exterior surface contoured inward and having a shape to match an exterior surface of the cake-receiving portion of the upper.

3. A container for cake pops comprising:

an upper and a lower that are mateable to one another to form a closed position in which the upper and lower define a plurality of cake pop-shaped cavities each having a cake receiving portion and a stick receiving portion, wherein each cake receiving portion of the lower has a base having a first exterior surface defining a first plane lying parallel to a sheet portion of the lower and a second exterior surface contoured inward and having a shape to match an exterior surface of the cake-receiving portion of the upper;

wherein each stick receiving portion has a terminal end that is an open end that terminates into a unitary cavity, wherein the unitary cavity has an internal first height that is greater than an internal second height of the stick receiving portion, and the unitary cavity is configured for a free end of a stick of each of a plurality of cake pops to be suspended therein in an unsupported manner; and in the mated form, the cake pop-shaped cavities are oriented as mirror image pairs having their respective stick receiving portions aligned with their respective terminal ends facing one another;

wherein a first portion of the unitary cavity defined by the upper or a second portion of the unitary cavity defined by the lower comprises a flange extending along one side thereof and protruding outward, wherein the flange is contoured to sit in registration on a surface of a respective unitary cavity of a separate container in a stacked configuration.

4. The container as claimed in claim 3, wherein the second exterior surface of the base of the lower is an inverted dome surface mateable for stacking on a spherical exterior surface of a cake-receiving portion of a non-mated upper.

5. A container for cake pops comprising:

an upper and a lower that are mateable to one another to form a closed position in which the upper and lower define a plurality of cake pop-shaped cavities each having a cake receiving portion and a stick receiving portion, wherein each cake receiving portion of the lower has a base having a first exterior surface defining a first plane lying parallel to a sheet portion of the lower and in surrounding relationship to a second exterior surface of the base, wherein each second exterior surface is contoured inward toward the cake pop-shaped cavity thereof and is configured to nest with an exterior surface of the cake-receiving portion of the upper, thereby defining a first stacking feature;

wherein the second exterior surface of the base of the lower is an inverted dome surface mateable for stacking on a spherical exterior surface of a cake-receiving portion of a non-mated upper;

wherein each stick receiving portion has a terminal end that is an open end that terminates into a unitary cavity, wherein the unitary cavity has an internal first height that is greater than an internal second height of the stick receiving portion, and the unitary cavity is configured for a free end of a stick of each of a plurality of cake pops to be suspended therein in an unsupported manner; and in the mated form, the cake pop-shaped cavities are oriented as mirror image pairs having their respective stick receiving portions aligned with their respective terminal ends facing one another.

6. The container as claimed in claim 5, wherein, in the mated form, the stick receiving portion is a cylindrically shaped tube have a length in a range of ½ inch to 2½ inch.

7. The container as claimed in claim 5, comprising at least two mirror image pairs of cake pop-shaped receiving cavities.

8. The container as claimed in claim 5, wherein the first plane of the lower further comprises a third exterior surface of a mating stacking feature positioned on the unitary cavity and shaped to mate with a co-mating stacking feature of a separate container for cake pops, thereby defining a second stacking feature.

9. The container as claimed in claim 5, wherein a first planar exterior surface of the unitary cavity defined by the lower lies parallel to the sheet portion of the lower and comprises a mating stacking feature, and a second planar exterior surface of the unitary cavity defined by the upper lies parallel to a sheet portion of the upper and comprises a co-mating stacking feature, thereby defining a second stacking feature.

10. The container as claimed in claim 9, wherein a third exterior surface of each cake-receiving portion of the upper has a domed exterior surface, and the upper defines an outer plane in which an outermost point of each domed exterior surface and the second planar exterior surface of the unitary cavity both lie.

11. The container as claimed in claim 5, wherein the upper and the lower are formed of molded plastic.

12. The container of claim 5, wherein each cake pop-shaped cavity is oriented at an angle relative to the central longitudinal axis and positions the terminal end of each stick receiving portion closer to the central longitudinal axis than a junction of each stick receiving portion with a respective cake receiving portion.

13. The container as claimed in claim 12, wherein at least one of the plurality of cake pop-shaped cavities has the cake receiving portion thereof positioned offset in two dimensions from an immediately neighboring cake receiving portion of another of the plurality of cake pop-shaped cavities.

14. The container as claimed in claim 12, wherein the second exterior surface of the base of the lower is an inverted dome surface mateable for stacking on a domed exterior surface of a cake-receiving portion of a non-mated upper.

15. The container as claimed in claim 14, wherein each stick receiving portion has an open terminal end that terminates into a unitary cavity having a first planar exterior surface defined by the lower and a second planar exterior surface defined by the upper, and the second planar exterior surface of the upper and an outermost point of the domed exterior surface of a cake-receiving portion of the upper collectively define an outer plane of the upper.

16. The container as claimed in claim 5, wherein the upper and lower in the closed position comprise mating means selected from the group consisting of a fastener, an adhesive tape or adhesive label, a shrink wrap band, a heat weld, and combinations thereof.

17. The container as claimed in claim 16, wherein the fastener is selected from the group consisting of a snap-fit detent and mating receptacle, a snap-fit or friction fit mating flanges, a deformable flange, a depressible tab, and combinations thereof.

18. The container as claimed in claim 5, wherein a first portion of the unitary cavity defined by the upper or a second portion of the unitary cavity defined by the lower comprises a flange extending along one side thereof and protruding outward, wherein the flange is contoured to sit in registration on a surface of a respective unitary cavity of a separate container in a stacked configuration.

* * * * *